US010857801B2

(12) United States Patent
Horade

(10) Patent No.: US 10,857,801 B2
(45) Date of Patent: Dec. 8, 2020

(54) INKJET RECORDING APPARATUS CAPABLE OF SUPPRESSING DEVIATION BETWEEN RESIDUAL INK QUANTITY INDICATED BY COUNT VALUE AND ACTUAL INK QUANTITY IN INK CHAMBER

(71) Applicant: BROTHER KOGYO KABUSHIKI KAISHA, Nagoya (JP)

(72) Inventor: Kenta Horade, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 15/904,663

(22) Filed: Feb. 26, 2018

(65) Prior Publication Data

US 2018/0244055 A1 Aug. 30, 2018

(30) Foreign Application Priority Data

Feb. 27, 2017 (JP) ..... 2017-034884

(51) Int. Cl.
*B41J 2/175* (2006.01)
*B41J 2/045* (2006.01)
*B41J 29/13* (2006.01)

(52) U.S. Cl.
CPC ..... *B41J 2/17509* (2013.01); *B41J 2/0457* (2013.01); *B41J 2/04548* (2013.01);
(Continued)

(58) Field of Classification Search
CPC ..... B41J 2/17566
See application file for complete search history.

(56) References Cited

U.S. PATENT DOCUMENTS

2002/0024543 A1 2/2002 Kimura et al.
2013/0257972 A1* 10/2013 Kubo ..... B41J 2/04548 347/19

(Continued)

FOREIGN PATENT DOCUMENTS

JP 2016-132217 A 7/2016
JP 2016-132221 A 7/2016

OTHER PUBLICATIONS

Notice of Allowance issued in related U.S. Appl. No. 15/904,672, dated Dec. 18, 2019.

*Primary Examiner* — Shelby L Fidler
(74) *Attorney, Agent, or Firm* — Merchant & Gould P.C.

(57) ABSTRACT

An inkjet recording apparatus includes: a tank having an ink chamber; a recording head; a memory; a display; an operation interface; a power switching section; and a controller. The power switching section is configured to be switched between a first state where an electric power is supplied to the recording head and the display and a second state where supply of an electric power to the recording head and the display is interrupted. After the power switching section is switched from the second state to the first state, the controller executes a query process to: display a query screen inquiring whether the ink chamber has been refilled with ink; and receive one of a first operation and a second operation. In response to receiving the first operation indicating that ink chamber has been refilled with ink, the controller executes an initialization process to initialize a count value.

14 Claims, 11 Drawing Sheets

(52) U.S. Cl.
CPC ..... *B41J 2/17513* (2013.01); *B41J 2/17566* (2013.01); *B41J 29/13* (2013.01); *B41J 2002/17573* (2013.01)

(56) References Cited

U.S. PATENT DOCUMENTS

| | | | | |
|---|---|---|---|---|
| 2016/0207339 | A1 | 7/2016 | Honoki | |
| 2016/0214392 | A1 | 7/2016 | Honoki et al. | |
| 2017/0057240 | A1 * | 3/2017 | Munakata | B41J 2/17566 |

* cited by examiner

INKJET RECORDING APPARATUS CAPABLE OF SUPPRESSING DEVIATION BETWEEN RESIDUAL INK QUANTITY INDICATED BY COUNT VALUE AND ACTUAL INK QUANTITY IN INK CHAMBER

CROSS REFERENCE TO RELATED APPLICATION

This application claims priority from Japanese Patent Application No. 2017-034884 filed Feb. 27, 2017. The entire content of the priority application is incorporated herein by reference.

TECHNICAL FIELD

The present disclosure relates to an inkjet recording apparatus configured to record an image on a sheet.

BACKGROUND

Japanese Patent Application Publication No. 2016-132221 discloses one example of an inkjet recording apparatus with refillable ink tanks. A user injects ink from an ink bottle into an ink chamber through an inlet opening formed in the ink tank. The inkjet recording apparatus is provided with a cover for covering the inlet opening for the ink chamber. When the inkjet recording apparatus detects using a cover sensor that the cover was opened and then closed (hereinafter simply describe as "when the cover is opened and closed"), the inkjet recording apparatus prompts the user to indicate whether the ink chamber has been refilled with ink. In response to the user operation to indicate that the ink chamber has been refilled with ink, the conventional inkjet recording apparatus initializes a count value indicative of a residual ink quantity.

SUMMARY

However, the inkjet recording apparatus disclosed in Japanese Patent Application Publication No. 2016-132221 cannot detect that the cover is opened and closed while electric power is not supplied to the cover sensor, and hence, cannot confirm with the user whether the ink chamber was refilled in such cases. That is, the inkjet recording apparatus cannot initialize the count value if the user injects ink into the ink chamber while the inkjet recording apparatus is in a power OFF state. This causes a deviation between the residual ink quantity indicated by the count value and an actual quantity of ink stored in the ink chamber in a case where the ink chamber is refilled with ink while the inkjet recording apparatus is in the power OFF state. This problem may occur not only when the inkjet recording apparatus initializes the count value when the cover is opened and closed, but may also occur when the inkjet recording apparatus initializes the count value by means of other methods.

In view of the foregoing, it is an object of the present disclosure to provide an inkjet recording apparatus capable of suppressing deviation between a residual quantity of ink indicated by a count value and an actual quantity of ink stored in an ink chamber.

In order to attain the above and other objects, according to one aspect, the disclosure provides an inkjet recording apparatus including: a tank; a recording head; a memory; a display; an operation interface; a power switching section; and a controller. The tank has an ink chamber configured to store ink therein and formed with an inlet through which the ink is supplied into the ink chamber. The recording head is configured to eject the ink stored in the ink chamber toward a sheet to record an image thereon: The memory stores a first threshold value and a count value. The count value is indicative of an accumulated count value accumulated from an initial value and is updated toward the first threshold value in accordance with ejection of ink from the ink chamber. The operation interface is configured to receive a user operation including a specific operation, a first operation, and a second operation. The power switching section is configured to be switched between a first state and a second state. Under the first state, the power switching section supplies an electric power to both the recording head and the display, whereas under the second state, the power switching section interrupts supplying the electric power to both the recording head and the display. The controller is configured to: receive the specific operation through the operation interface; in response to receiving the specific operation through the operation interface, switch the power switching section from the second state to the first state; after the power switching section is switched from the second state to the first state, execute a query process to: control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value.

According to another aspect, the disclosure provides an inkjet recording apparatus including: a tank; a recording head; a memory; a display; an operation interface; a power switching section; and a controller. The tank has an ink chamber configured to store ink therein and formed with an inlet through which the ink is supplied into the ink chamber. The recording head is configured to eject the ink stored in the ink chamber toward a sheet to record an image thereon. The memory stores a first threshold value and a count value. The count value is indicative of an accumulated count value accumulated from an initial value. The operation interface is configured to output a first operation signal, a second operation signal, and a third operation signal. The power switching section is configured to be switched between a first state and a second state. Under the first state, the power switching section supplies an electric power to both the recording head and the display, whereas under the second state, the power switching section interrupts supplying the electric power to both the recording head and the display. The controller is configured to update the count value toward the first threshold value in accordance with ejection of ink from the ink chamber. The controller is further configured to: receive the third operation signal from the operation interface; in response to receiving the third operation signal, switch the power switching section from the second state to the first state; after the power switching section is switched from the second state to the first state, execute a query process to: control the display to display a query screen inquiring whether the ink chamber has been refilled with ink; and receive either one of the first operation signal and the second operation signal from the operation interface, wherein the first operation signal indicates that the ink chamber has been refilled with ink, whereas the second operation signal indicates that the ink chamber has not been refilled with ink; and in response to receiving the first operation signal in the query process, execute an initialization process to set the count value to the initial value.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
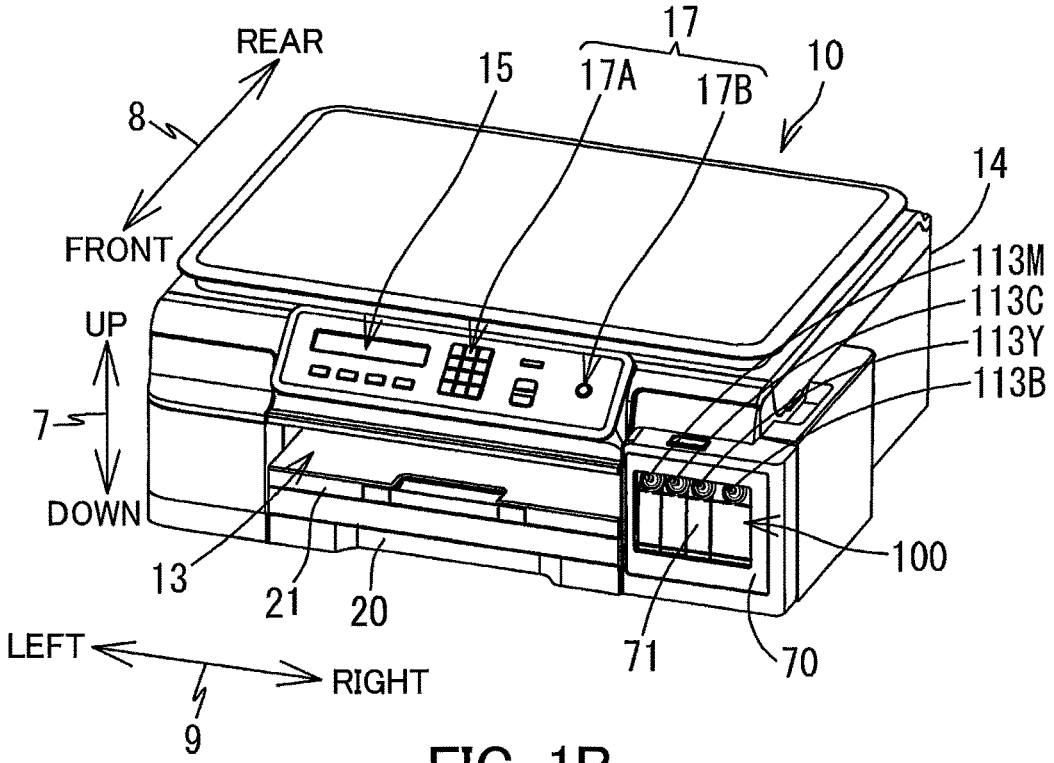
FIG. 1A is a perspective view of a multifunction peripheral (MFP) 10 according to one embodiment of the present disclosure, and illustrating a covering position of a cover 70 of the MFP 10.

Hereinafter, a multifunction peripheral (hereinafter abbreviated as "MFP") 10 according to one embodiment of the present disclosure will be described with reference to FIGS. 1 to 10. It would be apparent that the embodiment described below is merely an example of the disclosure and may be modified in many ways without departing from the scope of the disclosure.

In the following description, an up-down direction 7 is defined based on an orientation of the MFP 10 when the MFP 10 is ready to use (hereinafter referred to as an "operable posture"); a front-rear direction 8 is defined so that a side of the MFP 10 in which a discharge opening 13 is formed is a front side; and a left-right direction 9 is defined based on a perspective of an user facing the front side of the MFP 10.

<Overall Structure of MFP 10>

As illustrated in FIGS. 1A, 1B, 2, and 5, the MFP 10 includes a feed tray 20, a discharge tray 21, a conveying section 23, a recording section 24, and an ink tank 100. The ink tank 100 is an example of a tank. These components of the MFP 10 are accommodated in a casing 14 having a general rectangular parallelepiped shape. The MFP 10 has a printer function for recording images on sheets according to an inkjet recording method. The MFP 10 may also have other functions, such as a facsimile function and a scanning function. The MFP 10 is an example of an inkjet recording apparatus.

<Feed Tray 20 and Discharge Tray 21>

Figure 1B:
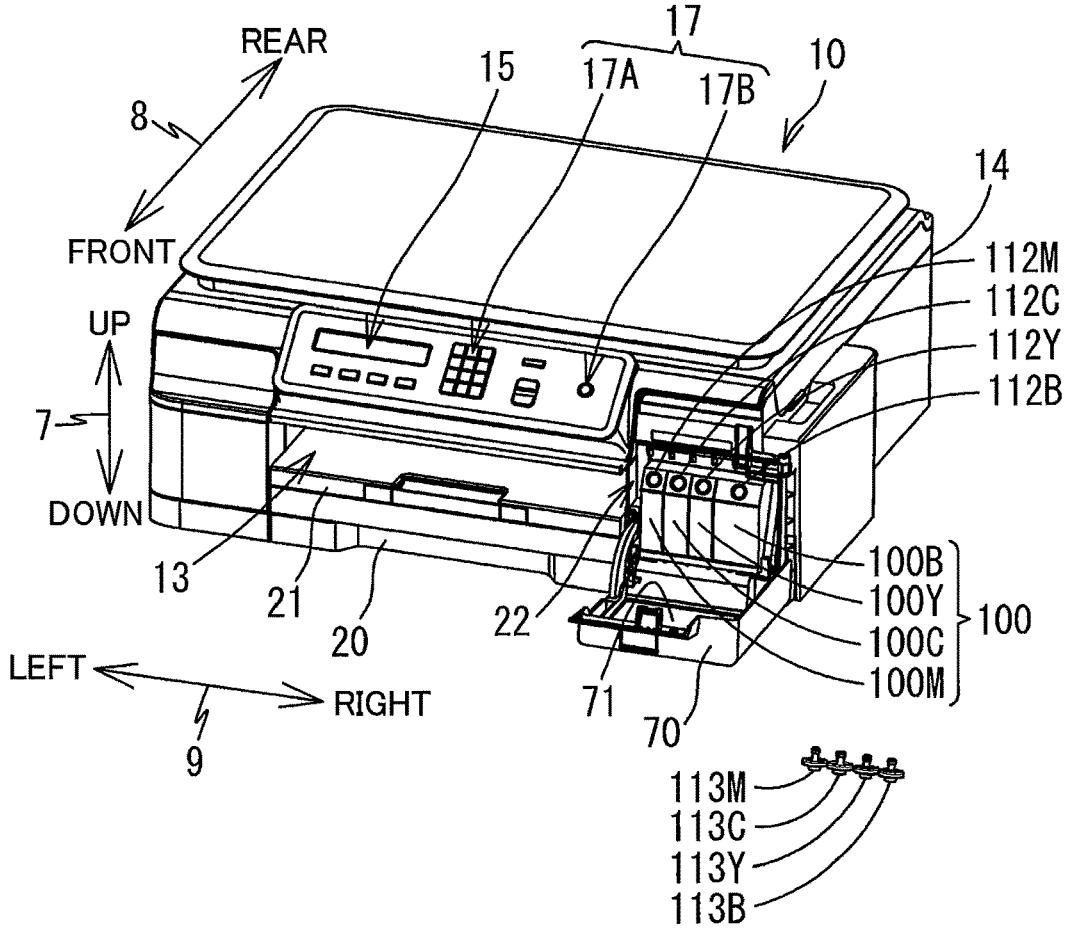
FIG. 1B is a perspective view of the MFP 10 according to the embodiment, and illustrating an exposing position of the cover 70.

As illustrated in FIGS. 1A and 1B, the discharge opening 13 is formed in a front surface of the casing 14 at its center region in the left-right direction 9. The feed tray 20 is inserted into and removed from the casing 14 through the discharge opening 13 in the front-rear direction 8. The feed tray 20 can support a plurality of sheets in a stacked state. The discharge tray 21 is disposed above the feed tray 20. The discharge tray 21 is inserted into and removed from the casing 14 together with the feed tray 20. The discharge tray 21 supports sheets discharged by the conveying section 23.

<Conveying Section 23 and Recording Section 24>

The conveying section 23 is configured to convey the sheets supported on the feed tray 20 along a conveying path that leads to the discharge tray 21 while passing through a position in which the sheets face the recording section 24. The conveying section 23 includes a plurality of rollers and the like that rotate while in contact with the sheets, for example. The recording section 24 is configured to record images on sheets conveyed by the conveying section 23 by ejecting ink stored in the ink tank 100. The recording section 24 includes a carriage that is movable in a main scanning direction crossing a direction in which the sheets are conveyed, and a recording head that is mounted on the carriage and configured to eject ink from nozzles, for example. The recording section 24 is an example of a recording head.

Figure 2:
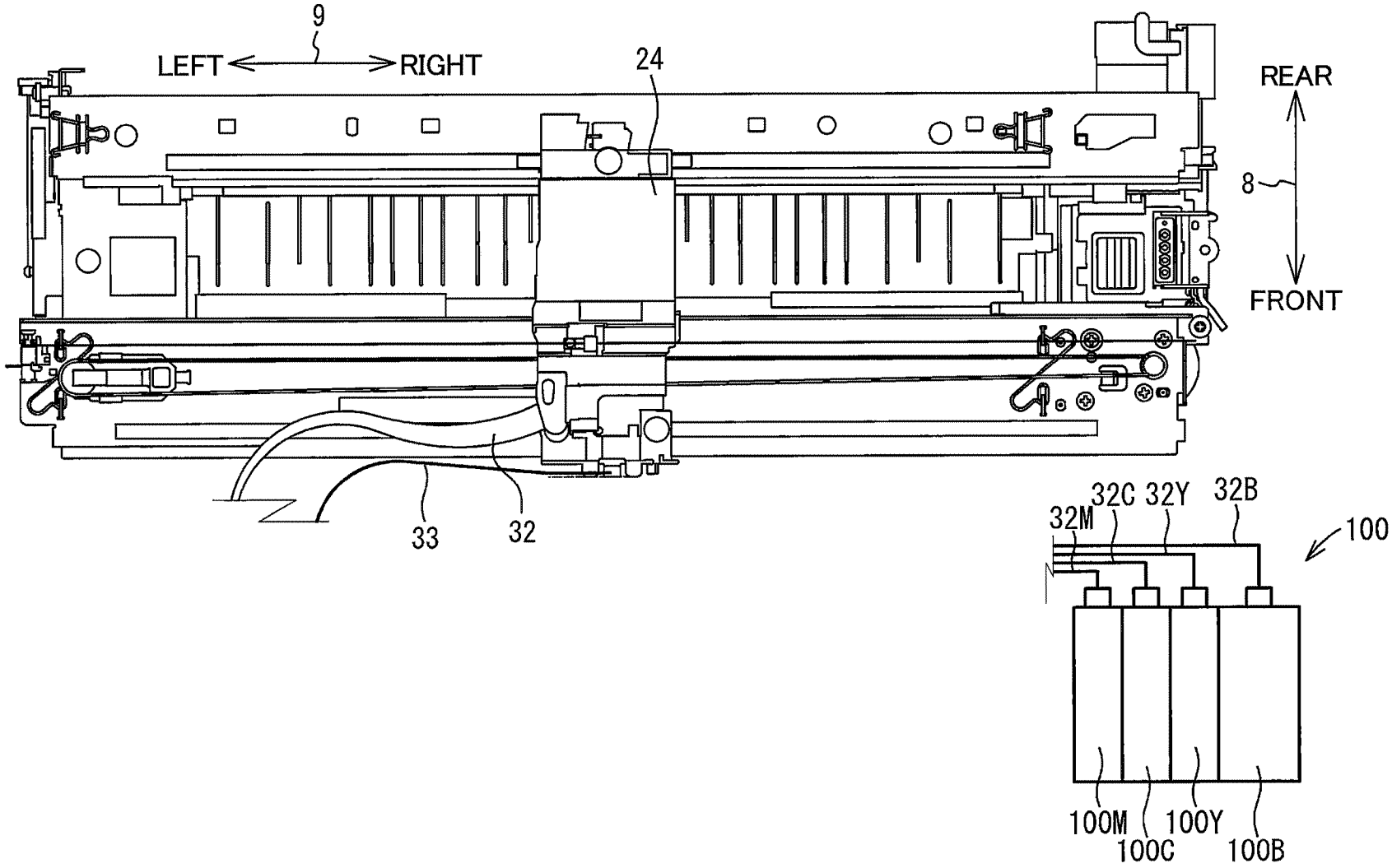
FIG. 2 is a plan view of a recording section 24 and an ink tank 100 in the MFP 10 according to the embodiment.

As illustrated in FIG. 2, ink tubes 32 and a flexible flat cable 33 are connected to the recording section 24. The ink tubes 32 are configured to supply ink stored in the ink tank 100 to the recording section 24. More specifically, the ink tubes 32 include four ink tubes 32B, 32Y, 32C, and 32M (hereinafter collectively referred to as the ink tubes 32) for allowing ink of four colors, i.e., black, magenta, cyan, and yellow, to flow therethrough, respectively. The ink tubes 32 are bundled together, with one end of the ink tubes 32 connected to and extending from the ink tank 100 and the other end connected to the recording section 24. The flexible flat cable 33 is configured to transmit control signals outputted from a controller 130 (see FIG. 5) to the recording section 24.

<Ink Tank 100>

As illustrated in FIGS. 1A and 1B, the ink tank 100 is installed in an interior space of the casing 14 at its right-front portion. That is, the ink tank 100 is fixed in the MFP 10 and cannot easily be removed from the casing 14. Here, the phrase "cannot easily be removed" is intended to mean that a general user cannot simply remove the ink tank 100 from the MFP 10 under normal operating conditions, for example. There is no need to install the ink tank 100 in such a way that makes them impossible to remove from the MFP 10.

The ink tank 100 is configured to store ink to be supplied to the recording section 24. As illustrated in FIG. 1B, the ink tank 100 includes four tanks 100B, 100Y, 100C, and 100M. Each of the tanks 100B, 100Y, 100C, and 100M stores ink of a different color. Specifically, the tank 100B stores black ink, the tank 100Y stores yellow ink, the tank 100C stores cyan ink, and the tank 100M stores magenta ink. However, the number of tanks 100B, 100Y, 100C, and 100M and the colors of ink stored therein are not limited to the above example.

The four tanks 100B, 100Y, 100C, and 100M are disposed in a row along the left-right direction 9. Of the four tanks 100B, 100Y, 100C, and 100M, the tank 100B is disposed farthest to the right while the tank 100M is disposed farthest to the left. The tank 100B has a width in the left-right direction 9 greater than those of the other tanks 100Y, 100C, and 100M. The tank 100B also has an ink chamber 111B (described later) with a capacity greater than those of ink chambers 111Y, 111C, and 111M of the other tanks 100Y, 100C, and 100M. However, arrangement of the tanks 100B, 100Y, 100C, and 100M, sizes of the tanks 100B, 100Y, 100C, and 100M, and capacities of the ink chambers 111 are not limited to the relationships described in the above example.

Figure 3:
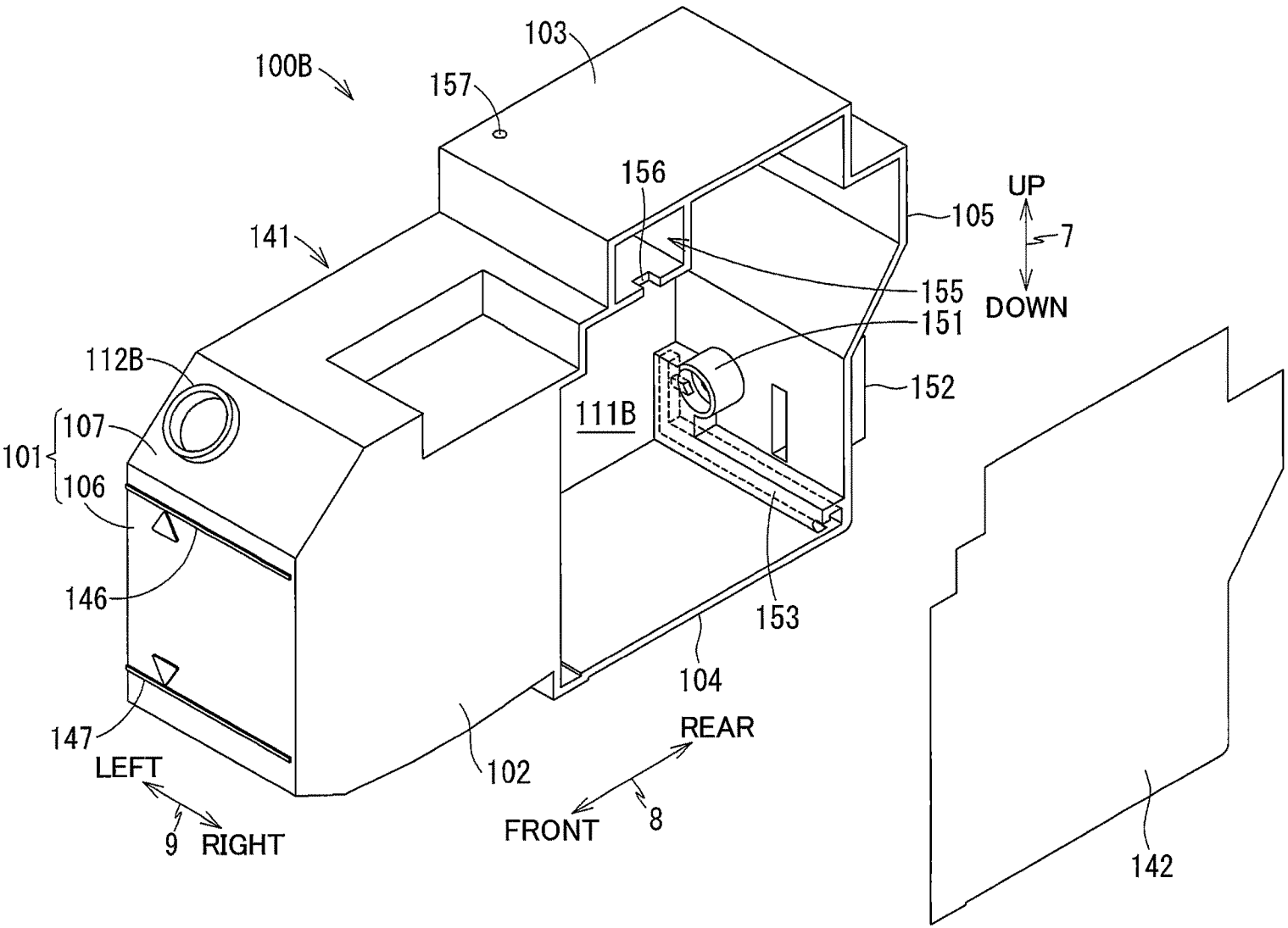
FIG. 3 is a perspective view of a tank 100B in the MFP 10 according to the embodiment as viewed from a front side thereof.
Figure 4:
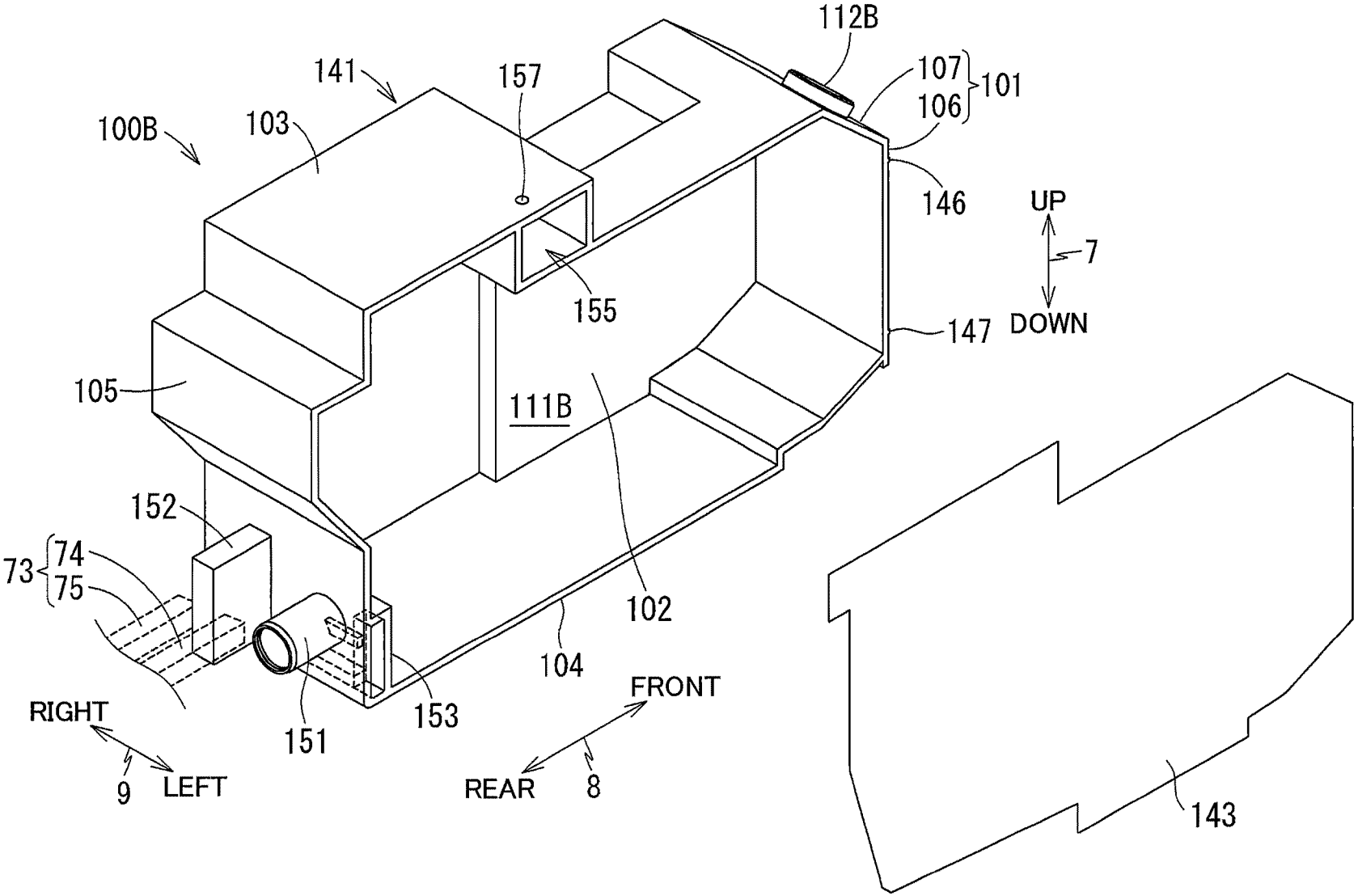
FIG. 4 is a perspective view of the tank 100B as viewed from a rear side thereof.

As illustrated in FIGS. 3 and 4, the tank 100B includes a frame 141, and two films 142 and 143. The frame 141 has a general rectangular parallelepiped shape that is flattened in the left-right direction 9 such that its dimensions in the up-down direction 7 and the front-rear direction 8 are greater than its dimension in the left-right direction 9. The frame 141 is formed of a resin (polypropylene, for example) that is sufficiently translucent to allow visual recognition of ink stored in the ink chamber 111B from outside the tank 100B. The frame 141 may be integrally molded through injection molding of a resin material, for example.

The frame 141 includes a front wall 101, a right wall 102, a top wall 103, a bottom wall 104, and a rear wall 105. A left end and part of a right end of the frame 141 are open. The films 142 and 143 are melt-bonded to the frame 141 so as to seal the openings in the left and right ends of the frame 141. An interior space of the tank 100B defined by the front wall 101, the right wall 102, the top wall 103, the bottom wall 104, the rear wall 105, and the films 142 and 143 constitutes the ink chamber 111B in which the ink is stored. Note that the ink chamber 111B may instead be defined by inner walls (not illustrated) positioned inside the outer walls 101-105 constituting the frame 141. Alternatively, the ink chamber 111B may be divided into a plurality of small regions by partitioning walls (not illustrated).

The front wall 101 is configured of a vertical wall 106, and a sloped wall 107. The vertical wall 106 expands in the up-down direction 7 and the left-right direction 9. The sloped wall 107 is connected between a top edge of the vertical wall 106 and a front edge of the top wall 103. The sloped wall 107 slopes relative to the up-down direction 7 and the front-rear direction 8. An inlet 112B is formed in the sloped wall 107. Ink is injected, or poured, into the ink chamber 111B through the inlet 112B. The inlet 112B penetrates the sloped wall 107 in a thickness direction thereof, allowing the ink chamber 111B to be in communication with an exterior of the tank 100B.

The inlet 112B is closed with a cap 113B. As illustrated in FIG. 1A, the cap 113B attached to the sloped wall 107 intimately contacts a surface of the sloped wall 107 defining a peripheral edge of the inlet 112B to seal the inlet 112B. As illustrated in FIG. 1B, on the other hand, the cap 113B is removed from the sloped wall 107 to open the inlet 112B. Here, the cap 113B can be attached to and removed from the sloped wall 107 while a cover 70 (described later) is in its exposing position. By removing the cap 113B from the inlet 112B, the user can inject ink into the ink chamber 111B through the inlet 112B.

As illustrated in FIGS. 3 and 4, a first line 146 and a second line 147 are provided on an outer surface of the vertical wall 106. The first line 146 and the second line 147 both extend in the left-right direction 9. When the MFP 10 is in its operable posture, the first line 146 is positioned approximately at a height in the up-down direction 7 the same as a level of ink in the ink chamber 111B when the ink chamber 111B stores ink of a preset maximum storage quantity. The maximum storage quantity corresponds to the quantity of ink stored in a single ink bottle (not illustrated), for example. When the MFP 10 is in its operable posture, the second line 147 is positioned lower in the up-down direction 7 than the first line 146 and higher in the up-down direction 7 than a detection position described later.

An ink supply portion 151 is provided at the rear wall 105. The ink supply portion 151 has a cylindrical shape with a hollow interior space. The ink supply portion 151 protrudes rearward from an outer surface of the rear wall 105. A distal end (i.e., protruding end) of the ink supply portion 151 is open. The interior space of the ink supply portion 151 is in communication with the ink chamber 111B through an ink channel 153 described later. By connecting the ink tube 32B to the ink supply portion 151 so that one end portion of the ink tube 32B covers an outer surface of the ink supply portion 151, ink stored in the ink chamber 111B is supplied to the ink tube 32B through the ink supply portion 151.

An ink detection portion 152 is provided at the rear wall 105. The ink detection portion 152 protrudes rearward from the outer surface of the rear wall 105. The ink detection portion 152 has a box shape with a hollow interior space. The ink detection portion 152 is formed of a light transmissive material that allows transmission of light irradiated from a light-emitting portion 74 described later. The interior space of the ink detection portion 152 is in communication with the ink chamber 111B. Hence, ink is present in the interior space of the ink detection portion 152 when the level of ink in the ink chamber 111B is higher than a lower edge of the ink detection portion 152. On the other hand, ink is not present in the interior space of the ink detection portion 152 when the level of ink in the ink chamber 111B is lower than the lower edge of the ink detection portion 152.

The ink channel 153 is a long narrow path for supplying ink stored in the ink chamber 111B to the ink supply portion 151. The ink channel 153 has one end that communicates with the ink chamber 111B at a position in contact with an inner surface of the bottom wall 104, and another end that communicates with the interior space of the ink supply portion 151. More specifically, the ink channel 153 extends leftward from its communicating position with the ink chamber 111B, and then extends upward at the left end of the tank 100B, and lastly extends rightward from a position of height equal to the ink supply portion 151 to communicate with the interior space of the ink supply portion 151.

An air communication portion 155 is also provided in the tank 100B. The air communication portion 155 is an air passage that allows the ink chamber 111B to communicate with external air. The air communication portion 155 is provided at a position upward relative to the inlet 112B in the up-down direction 7. The air communication portion 155 has one end that communicates with the ink chamber 111B through a notch 156 formed in a bottom wall of the air communication portion 155, and another end that communicates with an exterior of the tank 100B through a through-hole 157 penetrating the top wall 103. A labyrinth channel, a semipermeable membrane, or the like may be provided inside the air communication portion 155.

<Residual Ink Sensor 73>

Figure 5:
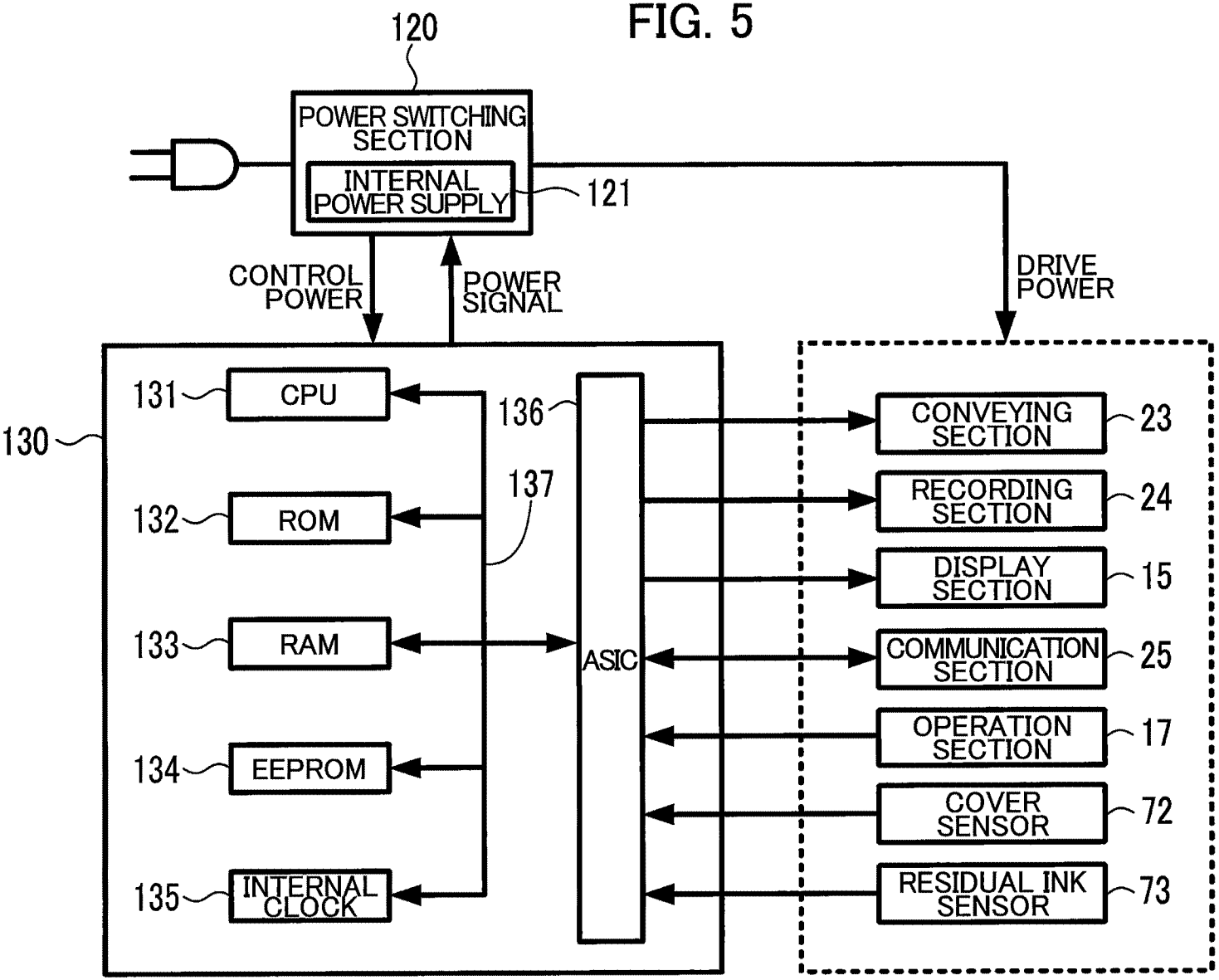
FIG. 5 is a functional block diagram of the MFP 10 according to the embodiment.

As illustrated in FIGS. 4 and 5, the MFP 10 also includes a residual ink sensor 73. The residual ink sensor 73 has the light-emitting portion 74 and a light-receiving portion 75. The light-emitting portion 74 and the light-receiving portion 75 are arranged to oppose each other in the left-right direction 9 with the ink detection portion 152 interposed therebetween. The light-emitting portion 74 is configured to output light (visible light or infrared light, for example) toward the light-receiving portion 75. The light can pass through walls constituting the ink detection portion 152 but not through black ink. The light-receiving portion 75 is configured to output a residual ink signal to the controller 130 based on whether the light-receiving portion 75 has received light outputted from the light-emitting portion 74 after the light passes through the ink detection portion 152. In other words, the residual ink sensor 73 is configured to output a residual ink signal to the controller 130 corresponding to the quantity of ink stored in the ink chamber 111B.

The residual ink sensor 73 according to the present embodiment is configured to output either a first residual ink signal or a second residual ink signal to the controller 130. The residual ink sensor 73 outputs the first residual ink signal in response to presence of ink at the detection position in the ink detection portion 152. On the other hand, the residual ink sensor 73 outputs the second residual ink signal in response to non-presence of ink at the detection position in the ink detection portion 152. In the present embodiment, the first residual ink signal outputted from the residual ink sensor 73 has a signal level of 0 V, while the second residual ink signal outputted from the residual ink sensor 73 has a signal level of 3.3 V. Hence, the phrase "the residual ink sensor 73 outputs a residual ink signal" includes cases in which the signal level is 0 V. However, combination of signal levels is not limited to the above example. Combination of position signals of a cover sensor 72 (described later) is also not limited to the example in the present embodiment.

The detection position is a position within the interior space of the ink detection portion 152 having a height in the up-down direction 7 the same as those of the light-emitting portion 74 and the light-receiving portion 75. The detection position in the up-down direction 7 is lower than the second line 147 and slightly higher than the interior space of the ink supply portion 151 when the IVIFP 10 is in its operable posture. Hence, the interior space of the ink supply portion 151 is filled with ink when the level of ink in the ink chamber 111B is aligned with the detection position. However, when the level of ink in the ink chamber 111B drops below the detection position, air introduced into the ink chamber 111B through the air communication portion 155 may enter the interior space of the ink supply portion 151. A difference in the up-down direction 7 between the detection position and the interior space in the ink supply portion 151 is preliminarily set based on an estimated quantity of ink required for recording an image on one sheet, for example.

Hence, the residual ink signal outputted from the residual ink sensor 73 switches from the first residual ink signal to the second residual ink signal at a timing in which the level of ink in the ink chamber 111B drops below the detection position. In the following description, a state of the ink chamber 111B when the residual ink sensor 73 outputs the second residual ink signal will be referred to as a "hard-empty" state. In other words, the term "hard-empty state" indicates a state of the ink chamber 111B just prior to air entering the interior space of the ink supply portion 151, for example. The hard-empty state is an example of a quantity of ink stored in the ink chamber 111B being less than a residual ink threshold. The residual ink threshold corresponds to the quantity of ink stored in the ink chamber 111B when the level of ink in the ink chamber 111B is at the detection position, for example.

Each of the tanks 100Y, 100C, and 100M may have a basic structure the same as that of the tank 100B. However, the tanks 100Y, 100C, and 100M are not provided with the ink detection portion 152. That is, the controller 130 cannot detect residual ink quantities in the corresponding ink chambers 111Y, 111C, and 111M using residual ink sensors 73. Hereinafter, the ink chambers 111B, 111Y, 111C, and 111M will be collectively referred to as the "ink chambers 111," the inlets 112B, 112Y, 112C, and 112M will be collectively referred to as the "inlets 112," and the caps 113B, 113Y, 113C, and 113M will be collectively referred to as the "caps 113."

<Cover 70>

As illustrated in FIG. 1B, the front surface of the casing 14 has a right end portion formed with an opening 22. The front surface of the ink tank 100 is exposed to an outside of the MFP 10 through the opening 22. The MFP 10 has the cover 70 that is pivotally movable between a covering position (a position illustrated in FIG. 1A) for covering the opening 22, and an exposing position (a position illustrated in FIG. 1B) for exposing the opening 22. The cover 70 is supported to the casing 14 at a bottom edge portion of the casing 14 so as to be pivotally movable about a pivot axis extending along the left-right direction 9.

In the covering position, the cover 70 covers all of the inlets 112B, 112Y, 112C, and 112M and restricts injection of ink into all of the ink chambers 111B, 111Y, 111C, and 111M through the inlets 112B, 112Y, 112C, and 112M. Here, the cover 70 in the covering position may be configured to cover the inlets 112 in their entirety or to cover just a portion of the inlets 112. When the cover 70 is in the exposing position, all of the inlets 112B, 112Y, 112C, and 112M are exposed outside the MFP 10, thereby allowing ink to be injected into all of the ink chambers 111B, 111Y, 111C, and 111M.

The user performs the following series of steps for filling the ink chambers 111 with ink. First, the user moves the cover 70 from the covering position to the exposing position and removes the cap 113 from the inlet 112 corresponding to the color of ink to be refilled. Next, the user inserts a tip of the ink bottle into the opened inlet 112 and injects all of ink in the ink bottle into the ink chamber 111. After the ink chamber 111 has been refilled, the user reattaches the cap 113 to the corresponding inlet 112 and moves the cover 70 back to the covering position.

The cover 70 has a transparent window 71. The transparent window 71 faces the front walls 101 of the tanks 100B, 100Y, 100C, and 100M when the cover 70 is in the covering position. With this configuration, the user can visually recognize the residual ink quantity of ink in the ink chambers 111 through the front walls 101, regardless of whether the cover 70 is in the covering position or the exposing position. On the other hand, the transparent window 71 may be omitted from the cover 70. In this case, the user must move the cover 70 to the exposing position in order to check the levels of ink in the ink chambers 111.

<Cover Sensor 72>

As illustrated in FIG. 5, the MFP 10 also includes the cover sensor 72. The cover sensor 72 may be a mechanical sensor, such as a switch that the cover 70 contacts and separates from, or an optical sensor for emitting light that is transmitted or interrupted depending on the position of the cover 70, for example. The cover sensor 72 is configured to output, to the controller 130, a position signal corresponding to the position of the cover 70.

The cover sensor 72 is configured to output either a first position signal or a second position signal to the controller 130. The first position signal outputted from the cover sensor 72 indicates that the cover 70 is in the covering position. The second position signal outputted from the cover sensor 72 indicates that the cover 70 is in a position other than the covering position (the exposing position, for example). In the present embodiment, the first position signal outputted from the cover sensor 72 has a signal level of 0 V, and the second position signal outputted from the cover sensor 72 has a signal level of 3.3. V. In the following description, an expression "cover open event" will be used to indicate that the position signal outputted from the cover sensor 72 has changed from the first position signal to the second position signal, while an expression "cover close event" will be used to indicate that the position signal outputted from the cover sensor 72 has changed from the second position signal to the first position signal.

<Display Section 15>

As illustrated in FIGS. 1A, 1B and 5, the MFP 10 also includes a display section 15. The display section 15 displays information for the user in the form of messages. While there are no particular limitations on the specific structure of the display section 15, a liquid crystal display or an organic electro-luminescence display may be employed as the display section 15, for example. The display section 15 is an example of a display.

The display section 15 according to the present embodiment has a rectangular shape with 8 dots vertically by 80 dots horizontally. Thus, the display section 15 can display a maximum of 16 characters (including spaces), each comprising 8 dots vertically by 5 dots horizontally (approximately 8 mm vertically by approximately 5 mm horizontally). Further, when attempting to display a character string exceeding 16 characters on the display section 15, the character string is displayed in a scrolling format. When attempting to display character strings in a plurality of lines on the display section 15, the character string for each line is displayed in sequence. However, the size of the display section 15 is not limited to the above example.

<Operation Section 17>

The MFP 10 also includes an operation section 17 for receiving user operations. The operation section 17 is an input interface that accepts input from a user indicating instructions for the MFP 10. The operation section 17 according to the present embodiment is configured of a plurality of push buttons, including a numeric keypad 17A and a power button 17B. However, the push buttons provided in the operation section 17 are not limited to the above example, and may include directional keys corresponding to "up", "down", "right", and "left". Further, the specific configuration of the operation section 17 is not limited to the push buttons, but may be a touchscreen superimposed over the display screen of the display section 15. The operation section 17 is an example of an operation interface.

The operation section 17 is configured to output, to the controller 130, operation signals corresponding to the push buttons that have been pressed. Specifically, the operation section 17 according to the present embodiment is configured to output a first operation signal, a second operation signal, and a third operation signal to the controller 130. The operation section 17 outputs the first operation signal to the controller 130 when the [1] button in the numeric keypad 17A has been pressed. The operation section 17 outputs the second operation signal to the controller 130 when the [2] button in the numeric keypad 17A has been pressed. The operation section 17 outputs the third operation signal to the controller 130 when the power button 17B has been pressed. The operation section 17 also outputs, to the controller 130, other operation signals corresponding to other buttons when the other buttons are pressed.

In the following description, an expression "the [1] button was pressed" will indicate that the operation section 17 outputted the first operation signal, an expression "the [2] button was pressed" will indicate that the operation section 17 outputted the second operation signal, and an expression "the power button 17B was pressed" will indicate that the operation section 17 outputted the third operation signal. Note that the buttons corresponding to the first operation signal, the second operation signal, and the third operation signal are not limited to the above example.

<Communication Section 25>

As illustrated in FIG. 5, the MFP 10 also includes a communication section 25. The communication section 25 is an interface through which the MFP 10 communicates with external devices. In other words, the MFP 10 is configured to transmit various data to external devices through the communication section 25 and to receive various data from external devices through the communication section 25. The communication section 25 may also function as a facsimile receiving section that receives facsimile data from external devices.

<Power Switching Section 120>

The MFP 10 also includes a power switching section 120. The power switching section 120 is configured to receive electric power from an external power source when the MFP 10 is plugged into the external power source, and to supply this electric power to various components in the MFP 10. More specifically, through the electric power acquired from the external power source, the power switching section 120 outputs drive power (24 V, for example) to the conveying section 23, the recording section 24, and the like and outputs control power (5 V, for example) to the controller 130. The power switching section 120 includes an internal power supply 121. The power switching section 120 charges the internal power supply 121 with part of the electric power supplied from the external power source.

The power switching section 120 can switch between a plug ON state and a plug OFF state. In the plug ON state, the MFP 10 is plugged into the external power source through a electric cable extending from the power switching section 120, and the MFP 10 receives electric power from the external power source through the plug. In the plug OFF state, the MFP 10 is unplugged, and the power switching section 120 does not receive electric power from the external power source. Hence, the power switching section 120 charges the internal power supply 121 with some of the electric power supplied from the external power source during the plug ON state, but does not charge the internal power supply 121 during the plug OFF state.

The power switching section 120 in the plug ON state can switch between a switch ON state and a switch OFF state based on a power signal outputted from the controller 130. When the power switching section 120 is in the switch OFF state, the controller 130 switches the power switching section 120 to the switch ON state in response to pressing of the power button 17B. Similarly, when the power switching section 120 is in the switch ON state, the controller 130 switches the power switching section 120 to the switch OFF state in response to pressing of the power button 17B. A user operation for pressing the power button 17B is an example of a specific operation.

In the switch OFF state, the power switching section 120 still supplies electric power to the controller 130 and the operation section 17, but does not supply electric power to the conveying section 23, the recording section 24, the display section 15, the communication section 25, the cover sensor 72, and the residual ink sensor 73. In other words, the controller 130 and the operation section 17 can still operate during the switch OFF state, but the conveying section 23, the recording section 24, the display section 15, the communication section 25, the cover sensor 72, and the residual ink sensor 73 are inoperable during the switch OFF state. During the switch ON state, electric power is supplied to the greater number of components of the MFP 10 than during the switch OFF state.

During the switch ON state, the power switching section 120 can switch between a drive state and an idle state based on a power signal outputted from the controller 130. The controller 130 switches the power switching section 120 from the idle state to the drive state when an operation is performed on the operation section 17 or when the controller 130 receives information through the communication section 25. The controller 130 switches the power switching section 120 from the drive state to the idle state when the operation section 17 has not been operated and the controller 130 has not received information through the communication section 25 for a prescribed time interval.

In the drive state, the power switching section 120 supplies electric power to all of the components in the MFP 10. In other words, all of the components in the MFP 10 are operable in the drive state. In the idle state, the power switching section 120 supplies electric power to the controller 130, the operation section 17, the communication section 25, the cover sensor 72, and the residual ink sensor 73, but does not supply electric power to the display section 15, the conveying section 23, the recording section 24. Hence, the controller 130, the operation section 17, the communication section 25, the cover sensor 72, and the residual ink sensor 73 are operable in the idle state, but the conveying section 23, the recording section 24, and the display section 15 are inoperable in the idle state.

<Controller 130>

As illustrated in FIG. 5, the controller 130 includes a central processing unit (CPU) 131, a read-only memory (ROM) 132, a random-access memory (RAM) 133, an electrically erasable programmable ROM (EEPROM) 134, and an application-specific integrated circuit (ASIC) 136. The CPU 131, the ROM 132, the RAM 133, the EEPROM 134, and the ASIC 136 are interconnected with one another via an internal bus 137. The ROM 132 stores programs and the like with which the CPU 131 controls various operations. The RAM 133 is used as a storage area for temporarily storing data, signals, and the like used when the CPU 131 executes the above programs, or as a work area for data processes. The EEPROM 134 stores settings, flags, and the like that must be preserved even during the plug OFF state. The ROM 132, the RAM 133, and the EEPROM 134 are examples of a memory.

The EEPROM 134 stores a count value for each of the ink chambers 111B, 111Y, 111C, and 111M. The count value in the present embodiment is set to an initial value (for example, 0) in S57 (described later) and is incremented in S16 (described later) based on the quantity of ink ejected from the recording section 24. In the following description, the count value for the ink chamber 111B will be referred to as the "count value B," the count value for the ink chamber 111Y will be referred to as the "count value Y," the count value for the ink chamber 111C will be referred to as the "count value C," and the count value for the ink chamber 111M will be referred to as the "count value M."

The EEPROM 134 also stores a first threshold value and a second threshold value for each of the ink chambers 111B, 111Y, 111C, and 111M. The first threshold value is set to a slightly smaller value (95, for example) than the maximum storage quantity (100, for example) of ink that can be stored in the corresponding ink chamber 111, for example. A difference between the maximum storage quantity and the first threshold value for the ink chamber 111B is equivalent to the residual ink threshold, for example. The second threshold value is set to a value (85, for example) closer to the initial value of the count value than the first threshold value is to the initial value. A difference between the maximum storage quantity and the second threshold value is equivalent to the quantity of ink stored in the corresponding ink chamber 111 when the level of ink in the ink chamber 111 is aligned with the second line 147, for example.

In the following description, a state of the ink chamber 111 when the difference between the first threshold value and the corresponding count value (first threshold value−count value) is less than 0 will be referred to as a "soft-empty" state. Further, a state of the ink chamber 111 when the difference between the second threshold value and the corresponding count value (second threshold value−count value) is less than 0 will be referred to as an "ink low" state. Hence, the ink chamber 111 arrives at the ink low state prior to the soft-empty state. Ideally or theoretically, a timing at which the ink chamber 111 reaches the soft-empty state is equivalent to a timing at which the ink chamber 111 reaches the hard-empty state. The difference between the first threshold value and the count value and the difference between the second threshold value and the count value may be used as estimation values of the quantity of ink remaining in the corresponding ink chamber 111. The soft-empty state is an example of a quantity of ink stored in the ink chamber 111 being less than the residual ink threshold.

Note that the count value, the first threshold value, and the second threshold value are not limited to the relationships described above. As an alternative example, the count value may be set to an initial value (100, for example) in S57, and may be decremented in S16 based on the quantity of ink ejected from the recording section 24. Here, the first threshold value may be set to a smaller value (5, for example) than the second threshold value (15, for example). In this variation, the soft-empty state is determined based on (count value−first threshold value), and the ink low state is determined based on (count value−second threshold value).

In other words, the count value should be updated in S16 in a direction approaching the first threshold value. Here, the expression "a direction approaching the first threshold value" represents the relationship between the count value and the first threshold value when the count value has been set to its initial value. That is, an incremented count value is continuously incremented, even after reaching the first threshold value. Similarly, a decremented count value is continuously decremented, even after reaching the first threshold value. Further, the second threshold value should be set to a value at which its difference with the count value reaches 0 before the difference between the count value and the first threshold value reaches 0.

The EEPROM 134 also stores a soft-empty flag, and an ink low flag for each of the ink chambers 111B, 111Y, 111C, and 111M. The soft-empty flag is information indicating whether the corresponding ink chamber 111 is in the soft-empty state. The soft-empty flag is set to either a value "ON" corresponding to the soft-empty state or a value "OFF" corresponding to a non-soft-empty state. The ink low flag is information indicating whether the corresponding ink chamber 111 is in the ink low state. The ink low flag is set to either a value "ON" corresponding to the ink low state or a value "OFF" corresponding to a non-ink-low state.

The soft-empty flag according to the present embodiment is set to "ON" when the difference between the first threshold value and the corresponding count value is less than 0 in S16, and is set to "OFF" in S57, for example. The ink low flag according to the present embodiment is set to "ON"

when the difference between the second threshold value and the corresponding count value is less than 0 in S16, and is set to "OFF" in S57, for example. The initial values of the soft-empty flag and the ink low flag are "OFF".

The EEPROM 134 also stores a hard-empty flag. The hard-empty flag is information indicating whether the ink chamber 111B has entered the hard-empty state the last time ink was ejected from the recording section 24. The hard-empty flag is set to either a value "ON" corresponding to the hard-empty state or a value "OFF" corresponding to a non-hard-empty state. The hard-empty flag according to the present embodiment is set to "ON" during image recording in S15 described later when the residual ink signal outputted from the residual ink sensor 73 switches from the first residual ink signal to the second residual ink signal, and is set to "OFF" in S57, for example. The initial value of the hard-empty flag is "OFF".

In the following description, the soft-empty flag and the ink low flag corresponding to the ink chamber 111B will be referred to as the "soft-empty flag B" and the "ink low flag B," respectively; the soft-empty flag and the ink low flag corresponding to the ink chamber 111Y will be referred to as the "soft-empty flag Y" and the "ink low flag Y," respectively; the soft-empty flag and the ink low flag corresponding to the ink chamber 111C will be referred to as the "soft-empty flag C" and the "ink low flag C," respectively; the soft-empty flag and the ink low flag corresponding to the ink chamber 111M will be referred to as the "soft-empty flag M" and the "ink low flag M," respectively. The hard-empty flag indicates the state of the ink chamber 111B, since the residual ink sensor 73 and the ink detection portion 152 are only provided for the tank 100B in the present embodiment. Hence, the soft-empty flag B may be omitted in this case.

Further, the conveying section 23, the recording section 24, the display section 15, the communication section 25, the operation section 17, the cover sensor 72, and the residual ink sensor 73 are connected to the ASIC 136. The controller 130 controls the conveying section 23 to convey sheets, controls the recording section 24 to eject ink, controls the display section 15 to display screens, and controls the communication section 25 to communicate with external devices. Further, the controller 130 acquires operation signals from the operation section 17, acquires position signals from the cover sensor 72, and acquires residual ink signals from the residual ink sensor 73. As an example, the controller 130 may read the position signal outputted from the cover sensor 72 and the residual ink signal outputted from the residual ink sensor 73 at prescribed time intervals (every 50 msec, for example).

The controller 130 also includes an internal clock 135 (otherwise known as a hardware clock) that outputs time information. The internal clock 135 is updated by electric power supplied from the external power source through the power switching section 120 when the power switching section 120 is in the plug ON state (i.e., in any of the switch OFF state, the switch ON state, the idle state, and the drive state). When the power switching section 120 is in the plug OFF state, on the other hand, the internal clock 135 is updated by electric power supplied from the internal power supply 121. When the charge in the internal power supply 121 is depleted, the time information outputted from the internal clock 135 is reset to an initial value (a null value, for example).

<Operation of MFP 10>

Next, operations of the MFP 10 according to the present embodiment will be described with reference to FIGS. 6 through 9. The CPU 131 of the controller 130 executes all processes described in FIGS. 6 through 9. Note that, to implement the following processes, the CPU 131 may read and execute a program stored in the ROM 132. Alternatively, the following processes may be implemented by hardware circuits mounted in the controller 130.

<Image Recording Process>

Figure 6:
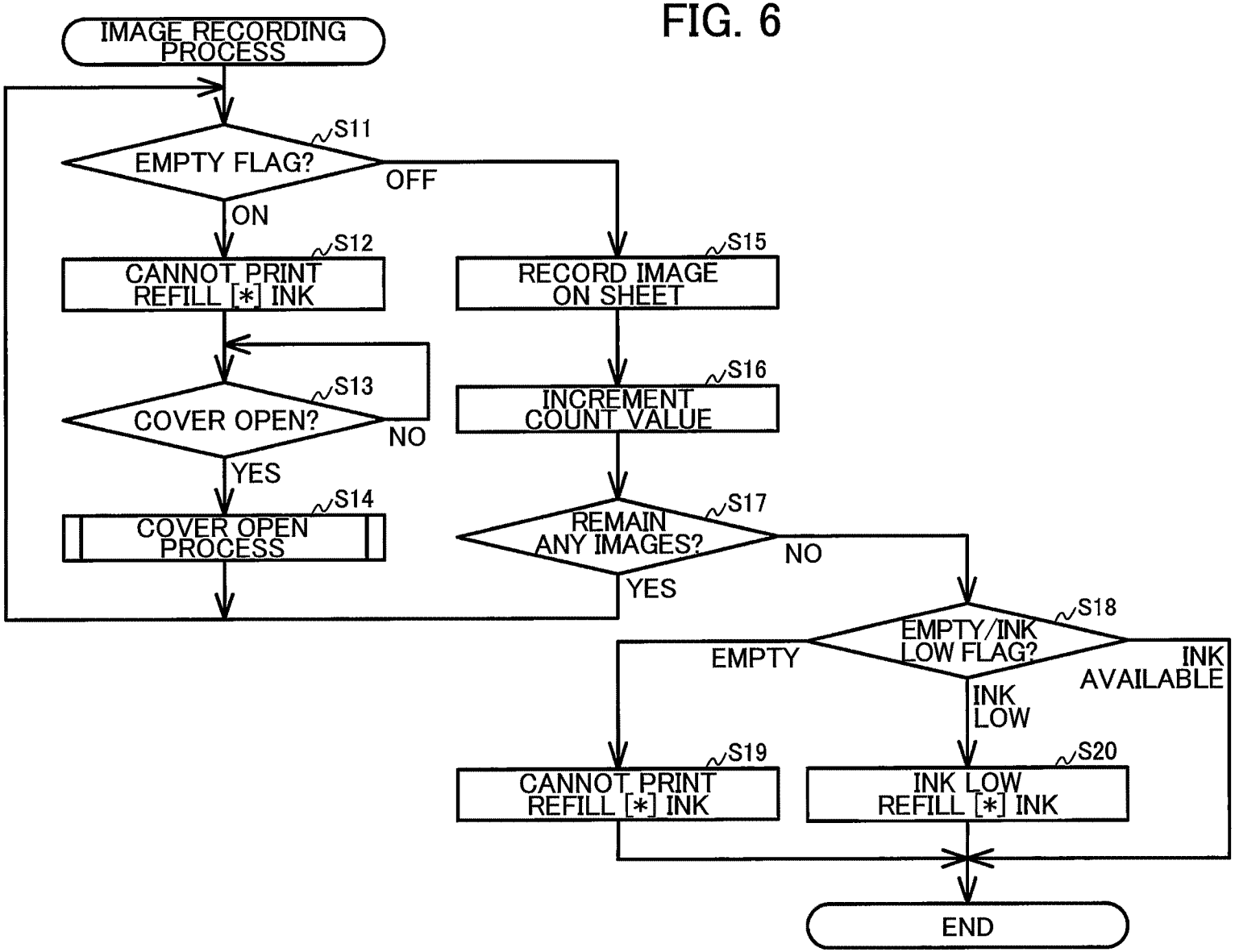
FIG. 6 is a flowchart illustrating steps in an image recording process executed by a controller 130 of the MFP 10 according to the embodiment.

The controller 130 executes the image recording process illustrated in FIG. 6 based on a recording instruction that is inputted into the MFP 10. The recording instruction is an instruction to the MFP 10 to execute a recording process for recording images on sheets based on image data. While there is no particular limitation on the source for acquiring the recording instruction, the recording instruction may be acquired from the user through the operation section 17 or may be acquired from an external device through the communication section 25, for example. In addition, the recording instruction may instruct the MFP 10 to record images on sheets based on fax data.

In S11 at the beginning of the image recording process in FIG. 6, the controller 130 determines the settings for the hard-empty flag and the soft-empty flags Y, C, and M. Specifically, the controller 130 determines whether at least one of the hard-empty flag and the soft-empty flags Y, C, and M is set to "ON" (S11: ON) or whether all of the hard-empty flag and the soft-empty flags Y, C, and M are set to "OFF" (S11: OFF). In response to the determination that at least one of the hard-empty flag and the soft-empty flags Y, C, and M is set to "ON" (S11: ON), in S12 the controller 130 controls the display section 15 to display an empty notification screen on the display section 15.

The empty notification screen is a notification screen for notifying the user that the recording process cannot be executed until ink has been refilled. More specifically, a character string "CANNOT PRINT" and a character string "REFILL [*] INK" are alternately displayed in the empty notification screen. Here, "[*]" is replaced with characters representing the colors of ink stored in the ink chambers 111. For example, the controller 130 may include characters in the empty notification screen that represent the colors of ink stored in ink chambers 111 whose corresponding hard-empty flag and soft-empty flags Y, C, and M have been set to "ON". The controller 130 controls the display section 15 to continuously display the empty notification screen on the display section 15 until the controller 130 detects the cover open event through the cover sensor 72 (S13: NO).

Next, the controller 130 detects the cover open event through the cover sensor 72 and executes the cover open process (described later, S14) in response to the detection of the cover open event through the cover sensor 72 (S13: YES). The cover open process is performed to prompt the user to indicate whether the ink chambers 111 have been refilled and to initialize the corresponding count values, hard-empty flag and soft-empty flags, ink low flags, and the like based on the user's responses. After completing the cover open process, the controller 130 repeats the process from S11. If any of the hard-empty flag and the soft-empty flags Y, C, and M is still set to "ON" after executing the cover open process (S11: ON), the controller 130 repeats the process from S12.

On the other hand, in response to the determination that all of the hard-empty flag and the soft-empty flags Y, C, and M have been set to "OFF" (S11: OFF), in S15 the controller 130 records images on sheets based on image data included in the recording instruction. The process in S15 is an example of a recording process. Thus, the recording section 24 can eject ink when all of the hard-empty flag and the soft-empty flags Y, C, and M have been set to "OFF", but cannot eject ink when even one of the hard-empty flag and the soft-empty flags Y, C, and M has been set to "ON".

More specifically, in S15 the controller 130 controls the conveying section 23 to convey a sheet supported in the feed tray 20 to a position facing the recording section 24. Next, the controller 130 controls the recording section 24 to eject ink toward the sheet facing the recording section 24 to record an image on the sheet. Subsequently, the controller 130 controls the conveying section 23 to discharge the sheet having an image recorded by the recording section 24 into the discharge tray 21.

In addition, in S16 the controller 130 counts the quantity of ink ejected from the recording section 24 in S15 for each color and increments the corresponding count value. The process in S16 is an example of an updating process. Note that the timing for incrementing the count values is not limited to the timing of S16. Any time ink is ejected from the recording section 24, the controller 130 increments the corresponding count values based on the quantities of ink ejected from the recording section 24, such as in a flushing process in which the recording section 24 ejects ink toward an ink receptor (not illustrated), or a maintenance process.

Here, the controller 130 sets the hard-empty flag to "ON" when the residual ink signal outputted from the residual ink sensor 73 switches from the first residual ink signal to the second residual ink signal while the recording section 24 ejects ink. Further, when the difference between any count value and the corresponding second threshold value becomes less than 0 while the count values are incremented, the controller 130 sets the corresponding ink low flag to "ON". Further, when the difference between any count value and the corresponding first threshold value becomes less than 0 while the count values are incremented, the controller 130 sets the corresponding soft-empty flag to "ON".

In S17 the controller 130 determines whether there remain any images indicated in the recording instruction that have not been recorded on sheets. Until the controller 130 records all images indicated in the recording instruction on sheets (S17: YES), the controller 130 returns to S11 and repeats the process in S11-S16 described above. After all images indicated in the recording instruction have been recorded on sheets (S17: NO), in S18 the controller 130 determines the settings for the hard-empty flag, the soft-empty flags Y, C, and M, and the ink low flags B, Y, C, and M. The process in S18 is an example of a fourth determination process.

In response to determination that any one of the hard-empty flag and the soft-empty flags Y, C, and M has been set to "ON" (S18: Empty), in S19 the controller 130 controls the display section 15 to display the empty notification screen on the display section 15. However, in response to the determination that all of the hard-empty flag and the soft-empty flags Y, C, and M have been set to "OFF" but any one of the ink low flags B, Y, C, and M has been set to "ON" (S18: Ink low), in S20 the controller 130 controls the display section 15 to display an ink low notification screen on the display section 15. The process in S19 and S20 are examples of a notification process.

The empty notification screen displayed in S19 may be identical to that displayed in S12. The ink low notification screen is a screen for notifying the user that the ink chamber 111 is approaching the soft-empty state. Specifically, a character string "INK LOW" and a character string "REFILL [*] INK" are alternately displayed in the ink low notification screen. Here, "[*]" is replaced with characters representing the colors of ink stored in ink chambers 111 in the ink low state.

The controller 130 controls the display section 15 to continuously display the empty notification screen or the ink low notification screen on the display section 15 until one of the following events occurs: the cover open event is detected through the cover sensor 72, the recording instruction is inputted, the operation section 17 is operated, or the state of the power switching section 120 changes to a state other than the drive state (i.e., the idle state, the switch OFF state, or the plug OFF state). On the other hand, in response to determination that all of the hard-empty flag, the soft-empty flags Y, C, and M, and the ink low flags B, Y, C, and M are set to "OFF" (S18: Ink available), the controller 130 ends the image recording process without executing either of the processes in S19 or S20.

<Switch ON Process>

Next, the switch ON process will be described with reference to FIG. 7A. The controller 130 executes the switch ON process when the power switching section 120 is switched to the switch ON state. In the example described in the present embodiment, the plug on the electric cable of the power switching section 120 is removed from the power outlet while the power switching section 120 is in a switch ON state, and is subsequently reinserted into the outlet.

Note that when the plug is removed from the outlet, the controller 130 according to the embodiment switches the power switching section 120 to both the plug OFF state and the switch OFF state. When the plug is reinserted into the outlet, the controller 130 switches the power switching section 120 back to the plug ON state and the switch ON state. Hence, in this example, the switch OFF state may be rephrased as the plug OFF state, a switch OFF time described later may be rephrased as a plug OFF time, a switch ON time described later may be rephrased as a plug ON time, and a switch OFF interval described later may be rephrased as a plug OFF interval.

As a variation, the controller 130 may switch the power switching section 120 from its plug OFF state to the plug ON state and the switch OFF state when the plug is inserted into the outlet. Thereafter, the controller 130 may change the power switching section 120 from the switch OFF state to the switch ON state in response to pressing of the power button 17B. In this case, the switch OFF interval is greater than the plug OFF interval by an amount of elapsed time between the plug being inserted into the outlet and the power button 17B being pressed.

While the power switching section 120 is in the switch ON state, the controller 130 repeatedly acquires time information from the internal clock 135 at prescribed intervals (every second, for example) and stores this acquired time information in the EEPROM 134 as switch OFF time information. In other words, the switch OFF time information stored in the EEPROM 134 just before the power switching section 120 is switched from the switch ON state to the switch OFF state indicates the time at which the power switching section 120 changes to the switch OFF state.

Figure 7A:
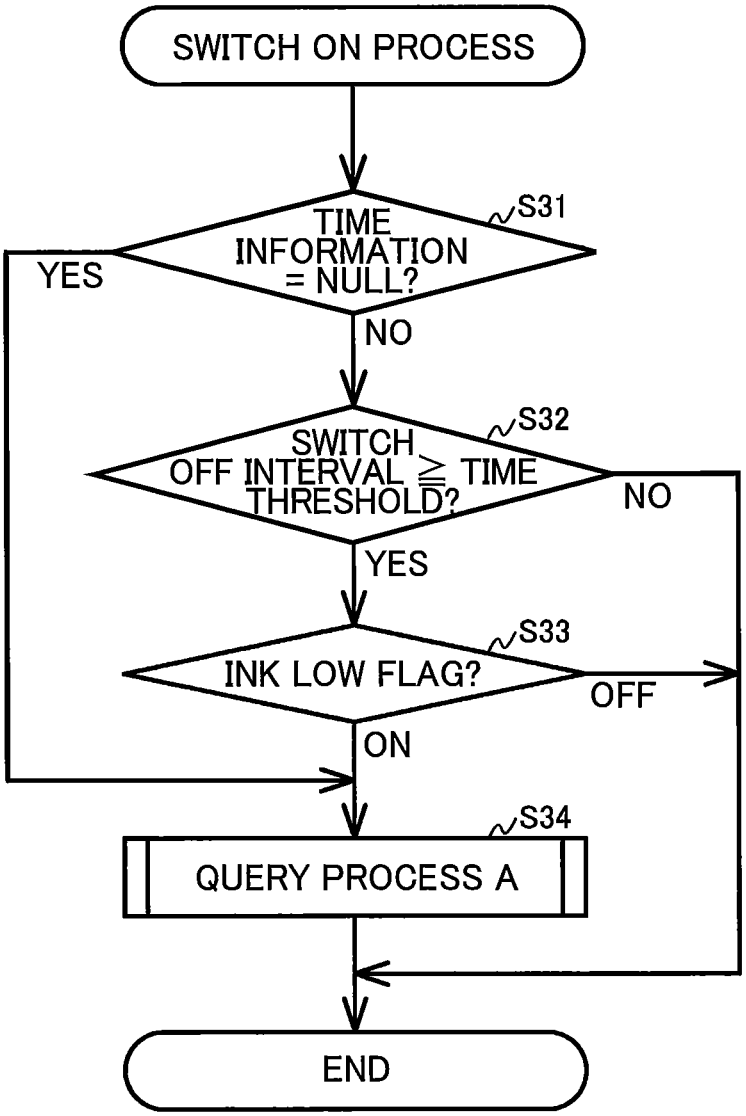
FIG. 7A is a flowchart illustrating steps in a switch ON process executed by the controller 130.

In S31 at the beginning of the switch ON process in FIG. 7A, in response to switch of the power switching section 120 to the switch ON state, the controller 130 acquires time information from the internal clock 135 and determines whether this time information is set to the initial value. In response to the determination that the time information acquired from the internal clock 135 is not the initial value (S31: NO), in S32 the controller 130 determines whether the switch OFF interval is greater than or equal to a time threshold. If so, in S33 the controller 130 determines whether the settings for the ink low flags B, Y, C, and M are "ON" or "OFF". The process in S31 is an example of a first determination process, the process in S32 is an example of a second determination process, and the process in S33 is an example of a third determination process.

The switch OFF interval is an example of a non-powered time duration during which the power switching section 120 is in the switch OFF state. In other words, the switch OFF interval is a continuous time interval during which electric power is not supplied to the recording section 24 and the display section 15. For example, the controller 130 acquires time information for the time at which the power switching section 120 enters the switch ON state from the internal clock 135 as switch ON time information. Next, the controller 130 calculates the switch OFF interval as a difference between the switch ON time indicated by the switch ON time information and the switch OFF time indicated by the switch OFF time information stored in the EEPROM 134. The time threshold is a preset time thought to be necessary for a typical user to inject ink into the ink chambers 111, for example. The time threshold may be a fixed value or may be a variable value that increases in length when the number of ink chambers 111 in the ink low state is greater, i.e., when the number of ink low flags set to "ON" is greater.

In response to the determination that the switch OFF interval is greater than or equal to the time threshold and in response to the determination that any one of the ink low flags B, Y, C, and M is set to "ON" (S32: YES and S33: ON), in S34 the controller 130 executes a query process A. Further, in response to the determination that the time information acquired from the interval clock is set to the initial value (S31: YES), the controller 130 skips the process in S32 and S33 and executes the query process A in S34. On the other hand, in response to the determination that the switch OFF interval is less than the time threshold (S32: NO) or in response to the determination that all of the ink low flags B, Y, C, and M are set to "OFF" (S33: OFF), the controller 130 ends the switch ON process without executing the query process A in S34.

<Query Process A>

Next, the query process A will be described with reference to FIG. 8. The query process A serves to inquire the user whether the ink chambers 111 have been filled with ink while the power switching section 120 was in the switch OFF state and to initialize the corresponding count values, hard-empty flag, soft-empty flags, and ink low flags for the ink chambers 111 based on the user's responses.

Figure 8:
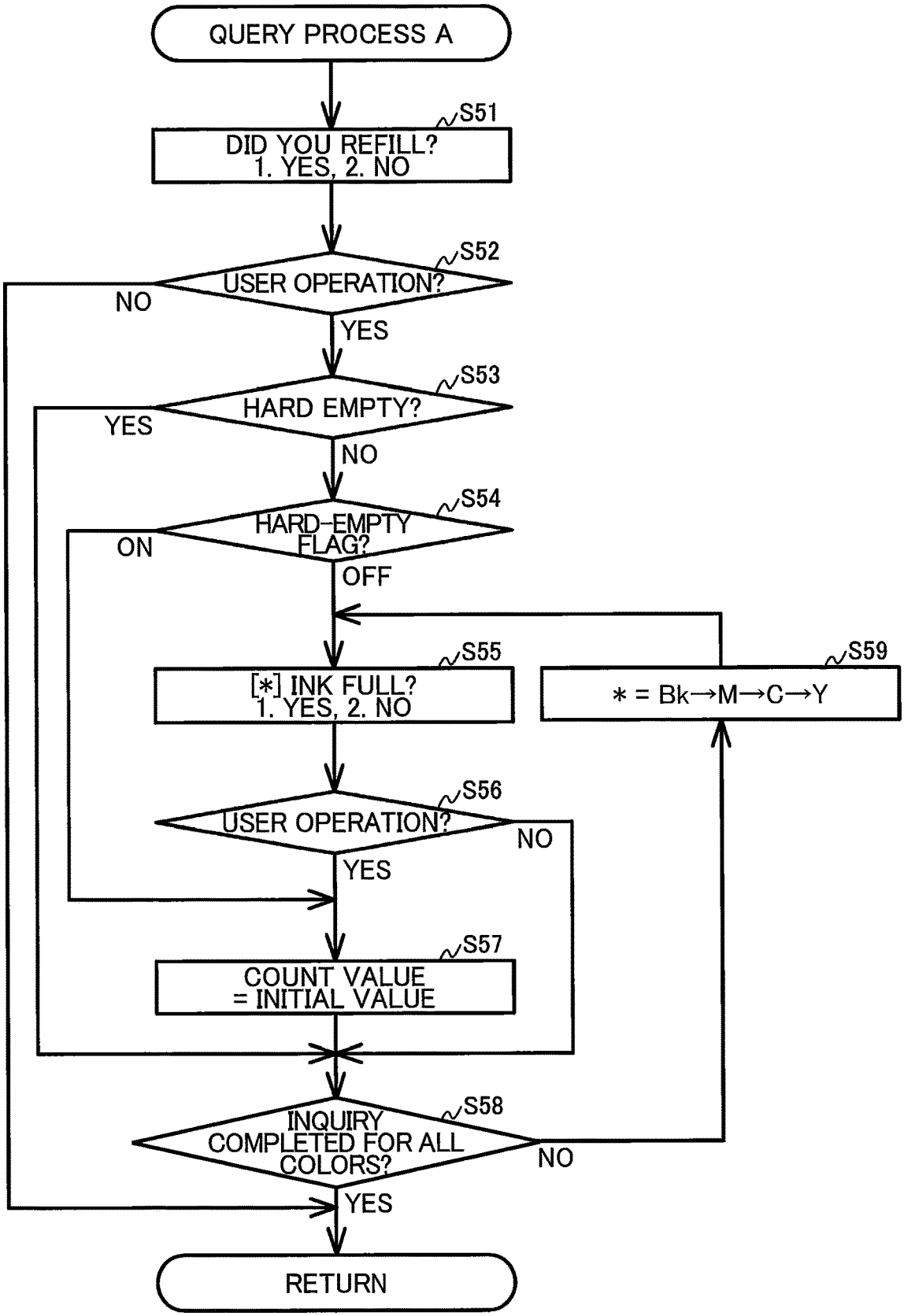
FIG. 8 is a flowchart illustrating steps in a query process A executed by the controller 130.

In S51 at the beginning of the switch ON process in FIG. 8, the controller 130 controls the display section 15 to display a preliminary inquiry screen on the display section 15. The preliminary inquiry screen prompts the user to indicate whether at least one of the ink chambers 111 has been refilled. For example, a character string "DID YOU REFILL?" and a character string "1. YES, 2. NO" are alternately displayed in the preliminary inquiry screen. The controller 130 controls the display section 15 to continuously display the preliminary inquiry screen on the display section 15 until a third operation or a fourth operation has been received through the operation section 17 (S52).

The third operation is a user operation for indicating that at least one of the ink chambers 111 has been refilled with ink and corresponds to pressing the [1] button, for example. The fourth operation is a user operation for indicating that none of the ink chambers 111 has been refilled with ink and corresponds to pressing the [2] button, for example.

In response to the pressing of the [1] button while the preliminary inquiry screen is displayed (S52: YES), in S53 and S54 the controller 130 determines whether any change occurred in the level of ink stored in the ink chamber 111B while the power switching section 120 was in the switch OFF state based on the detection results from the residual ink sensor 73. More specifically, the controller 130 compares the residual ink signal outputted from the residual ink sensor 73 at the timing of S53 to the setting for the hard-empty flag. The setting for the hard-empty flag does not change while the power switching section 120 is in the switch OFF state. In other words, the setting of the hard-empty flag at the timing of S54 indicates the state of the ink chamber 111B just prior to the power switching section 120 being switched to the switch OFF state. The process in S53 and S54 is an example of a fifth determination process.

In response to the determination that the ink chamber 111B is not in the hard-empty state at the timing of S53 and that the hard-empty flag is set to "OFF" (S53: NO and S54: OFF), in S55 the controller 130 controls the display section 15 to display an inquiry screen that targets the ink chamber 111B on the display section 15. The inquiry screen prompts the user to indicate whether the ink chamber 111B has been refilled with ink up to the level of its maximum storage quantity. For example, a character string "BK INK FULL?" and a character string "1. YES, 2. NO" are alternately displayed in the inquiry screen. The controller 130 controls the display section 15 to continuously display the inquiry screen on the display section 15 until a first operation or a second operation is received through the operation section 17 (S56).

The first operation is a user operation for indicating that the ink chamber 111B has been refilled with ink up to the level of its maximum storage quantity and corresponds to pressing the [1] button, for example. The second operation is a user operation either for indicating that the ink chamber 111B has been refilled with ink but not up to the level of its maximum storage quantity in a case where the [1] button is pressed in S52 and, of the ink chambers 111, the ink chamber 111B has been refilled or for indicating that the ink chamber 111B has not been refilled in a case where the [1] button is pressed in S52 but any of the ink chambers 111 other than the ink chamber 111B has been refilled. The second operation corresponds to pressing the [2] button, for example.

Note that the first operation and the third operation may correspond to pressing the same button or may correspond to pressing different buttons. This is also true for the second operation and the fourth operation. The process in S55 and S56 is an example of a query process.

In response to the pressing of the [1] button while the inquiry screen targeting the ink chamber 111B is displayed (S56: YES), in S57 the controller 130 sets count value B to an initial value (0) and sets the hard-empty flag, the soft-empty flag B, and the ink low flag B to "OFF". The process in S57 is an example of an initialization process. On the other hand, in response to the pressing of the [2] button while the inquiry screen targeting the ink chamber 111B is displayed (S56: NO), then the controller 130 jumps to S58 without executing the process in S57.

Meanwhile, in response to the determination that the ink chamber 111B is not in the hard-empty state at the timing of S53 but that the hard-empty flag is set to "ON" (S53: NO and S54: ON), the controller 130 skips the process in S55 and S56 for the ink chamber 111B and advances to the process in S57 for the ink chamber 111B. Further, in response to the determination that the ink chamber 111B is in the hard-empty state at the timing of S53 (S53: YES), the controller 130 skips the process in S55-S57 for the ink chamber 111B and jumps to S58. The ink chamber 111B is an example of a first ink chamber, while the ink chambers 111M, 111C, and 111Y are examples of a second ink chamber. Further, the count value B is an example of a first count value, and the count values M, C, and Y are examples of a second count value.

In S58 the controller 130 determines whether the process in S55-S57 has been completed for all colors of ink. In response to the determination that the process in S55-S57 has not been performed for all colors (S58: NO), in S59 the controller 130 sets the target color to the next color in the sequence Bk→M→C→Y. In this way, the process in S55-S57 is repeated for each of the ink chambers 111B, 111M, 111C, and 111Y. While repeating the process in S55-S57, the controller 130 performs the process in S57 on the target ink chamber 111 in response to the pressing of the [1] button, but does not perform this process in response to the pressing of the [2] button.

After the controller 130 has completed the process in S55-S57 for all the ink chambers 111 (S58: YES), the controller 130 ends the query process A. Note that the sequence in which the controller 130 performs the process in S55-S57 for the ink chambers 111B, 111M, 111C, and 111Y is not limited to the above example.

Further, in response to the pressing of the [2] button while the preliminary inquiry screen is displayed (S52: NO), the controller 130 ends the query process A without executing the process in S53-S59 even one time.

<Cover Open Process>

Next, the cover open process will be described with reference to FIG. 7B. The controller 130 executes the cover open process in response to detection of the cover open event through the cover sensor 72 when any of the ink chambers 111B, 111Y, 111C, and 111M are in the ink low state or the soft-empty state.

Figure 7B:
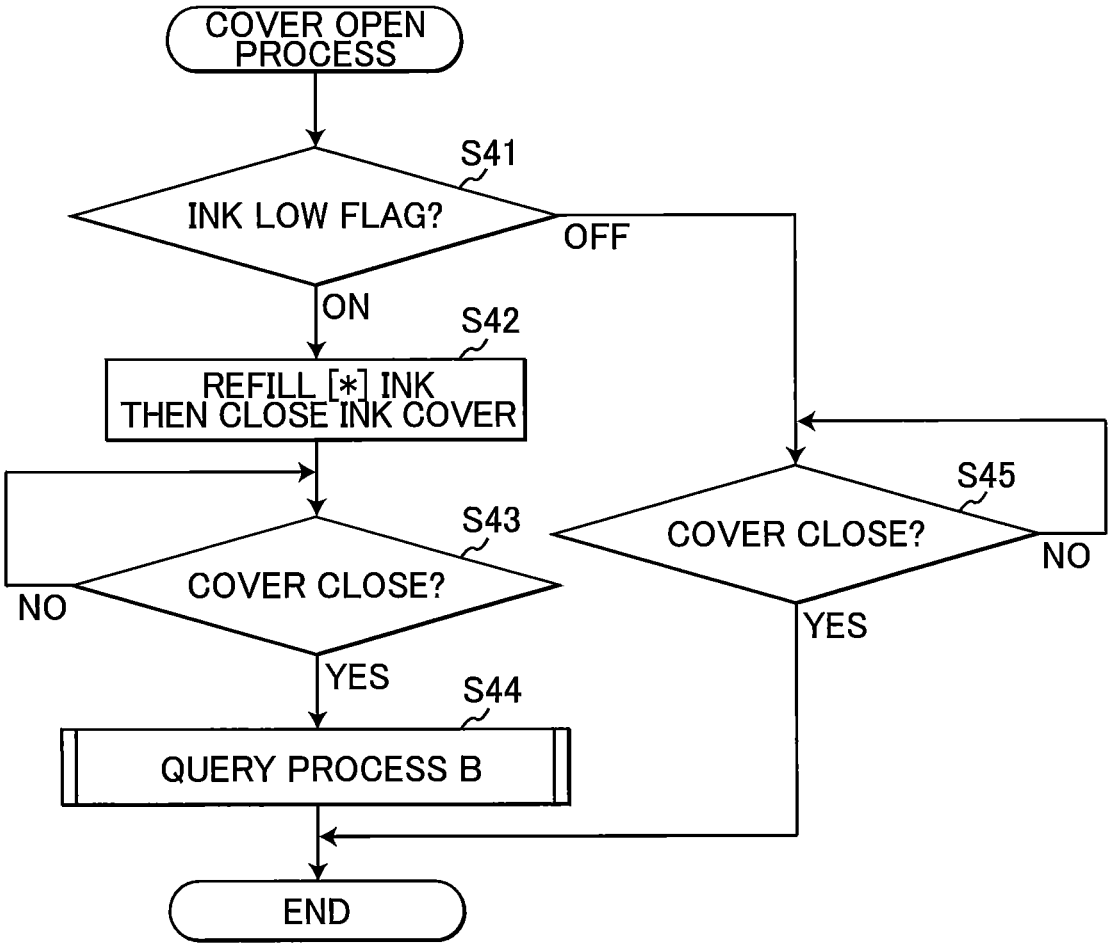
FIG. 7B is a flowchart illustrating steps in a cover open process executed by the controller 130.

In S41 at the beginning of the cover open process in FIG. 7B, the controller 130 determines the settings for the ink low flags B, Y, C, and M. In response to the determination that any of ink low flags B, Y, C, and M is set to "ON" (S41: ON), in S42 the controller 130 controls the display section 15 to display a refill notification screen on the display section 15. For example, a character string "REFILL [*] INK" and a character string "THEN CLOSE INK COVER" are alternately displayed in the refill notification screen. Here, "[*]" is replaced with characters representing the colors of ink that need to be refilled (Bk, Y, C, and M). The controller 130 may include, in the refill notification screen, characters representing the colors of ink stored in ink chambers 111 in the ink low state. The controller 130 controls the display section 15 to continuously display the refill notification screen on the display section 15 until the controller 130 detects the cover close event through the cover sensor 72 (S43: NO).

When viewing the refill notification screen, the user removes the cap 113 from the inlet 112 of the ink chamber 111 to be refilled and injects ink into the ink chamber 111. After refilling the ink chamber 111, the user closes the inlet 112 with the cap 113 and moves the cover 70 back to the covering position. At this time, the user may supply ink of only those colors indicated in the refill notification screen, may supply ink of all colors, or may not supply ink of any color. However, the controller 130 cannot detect what colors of ink were replenished.

In response to the detection of the cover close event through the cover sensor 72 (S43: YES), in S44 the controller 130 executes a query process B. The query process B is equivalent to the query process A in FIG. 8 with the omission of the process in S53 and S54.

Here, the controller 130 may be configured to execute the process in S44 in response to determination that a cover-open time duration during which the cover 70 was in the exposing position exceeds a time threshold. On the other hand, the controller 130 may end the cover open process without executing the process in S44 in response to the determination that the cover-open time is less than the time threshold. In this example, the cover-open time duration may be calculated as a difference between the time indicated by time information acquired from the internal clock 135 when the cover open event was detected and the time indicated by time information acquired from the internal clock 135 when the cover close event was detected.

On the other hand, in response to the determination that all of the ink low flags B, Y, C and M are set to "OFF" (S41: OFF), the controller 130 waits until the controller 130 detects the cover close event through the cover sensor 72 (S45: NO). In response to the detection of the cover close event through the cover sensor 72 (S45: YES), the controller 130 ends the cover open process without executing the query process B.

<Operational and Technical Advantages of the Embodiment>

In the embodiment described above, the controller 130 executes the query process A when the power switching section 120 is switched to the switch ON state. In response to the determination that the ink chamber 111 has been refilled with ink while the power switching section 120 is in the switch OFF state, the controller 130 initializes the corresponding count values, hard-empty flag and soft-empty flags, ink low flags for the ink chamber 111. Accordingly, the MFP 10 can suppress deviation between the residual ink quantity specified by the count value and the actual quantity of ink stored in the ink chamber 111 even when the ink chambers 111 have been refilled with ink while the power switching section 120 is in the switch OFF state.

If the ink chamber 111 has been refilled with ink while the power switching section 120 is in the switch ON state, the MFP 10 executes the query process B once the cover 70 is returned to the covering position after a user operation for refilling the ink chamber 111 is complete.

The time information acquired from the internal clock 135 in S31 may indicate the initial value when the charge in the internal power supply 121 has been depleted. That is, since the power switching section 120 has stayed in the switch OFF state for a long time, it is highly probable that the ink chamber 111 has been refilled during this time. Therefore, it is preferable in this case to execute the query process A when the power switching section 120 is switched to the switch ON state, without performing the process in S32 and S33.

Further, the operation to refill the ink chamber 111 takes a certain amount of time. That is, it is likely that ink has not been supplied while the power switching section 120 was in the switch OFF state if the switch OFF interval is less than the time threshold. However, if the controller 130 executes the query process A every time the power switching section 120 changes to the switch ON state, irrespective of whether the ink chamber 111 has been refilled, the user would be forced to perform more troublesome operations. Therefore, the controller 130 determines whether to perform the query process A based on the length of the switch OFF interval, thereby ensuring the accuracy of the count value while simplifying user operations.

Further, when the level of ink stored in the ink chamber 111 is lower, there is a high probability that the user supplies ink while the power switching section 120 is in the switch OFF state. Hence, in such cases it is preferable to execute the query process A when the power switching section 120 is switched to the switch ON state. On the other hand, the controller 130 does not execute the query process A when each ink chamber 111 contains a sufficient amount of ink, whereby the MFP 10 can simplify user operations.

In particular, if any of the ink low flags B, Y, C, and M is set to "ON", the user who intends to unplug the MFP 10 will view the ink low notification screen displayed on the display section 15 in S18. Therefore, the probability that the user will refill the ink chamber 111 with ink after unplugging the MFP 10 is higher. Therefore, the MFP 10 can execute the query process A at suitable timings by referencing the ink low flags in both S18 and S33.

Further, if the ink chamber 111B is not in the hard-empty state at the timing of S53 in FIG. 8 while the hard-empty flag is set to "ON", it is likely that the level of ink in the ink chamber 111B changed from below the detection position to above the detection position while the power switching section 120 was in the switch OFF state, that is, the ink chamber 111B has been refilled with ink while the power switching section 120 was in the switch OFF state. Since the controller 130 executes the process in S57 while skipping the process in S55 and S56 for the ink chamber 111B in such cases, the MFP 10 can set an accurate count value for the ink chamber 111B while simplifying user operations.

However, if the ink chamber 111B is in the hard-empty state at the timing of S53, it is likely that the level of ink in the ink chamber 111B remained below the detection position while the power switching section 120 was in the switch OFF state (i.e., the ink chamber 111B has not been refilled). In such cases, by skipping the process in S55-S57 targeting the ink chamber 111B, the MFP 10 can ensure an accurate count value and simplify user operations.

Note that it is necessary to determine that the ink chamber 111B is in the hard-empty state at the timing of S53 and that the hard-empty flag is set to "ON" in order to determine with accuracy whether the level of ink in the ink chamber 111B remained below the detection position while the power switching section 120 was in the switch OFF state. However, since ink is usually not extracted from the ink chambers 111, the MFP 10 may determine that the ink level in the ink chamber 111B has not changed from a level below the detection position when the ink chamber 111B is in the hard-empty state at the timing of S53.

Note that the correlation between the results of determinations in S53 and S54 and the necessity to execute steps S55-S57 for the ink chamber 111B is not limited to the above example. That is, the controller 130 may execute the query process A' illustrated in FIG. 10, instead of executing the query process A illustrated in FIG. 8. The process of S151-159 in the query process A' corresponds to the process of S51-59 in the query process A except for the process in S154. More specifically, in response to the determination that the ink chamber 111B is not in the hard-empty state at the timing of S153 and that the hard-empty flag is set to "ON" (S153: NO and S154: ON), the controller 130 executes the process in S155-S157 targeting the ink chamber 111B. On the other hand, in response to the determination that the ink chamber 111B is not in the hard-empty state and the hard-empty flag is set to "OFF" (S153: NO and S154: OFF), the controller 130 jumps to S158 without executing the process in S155-S157 targeting the ink chamber 111B.

The present embodiment describes an example in which the trigger for the controller 130 to execute the process in FIG. 7A is the power switching section 120 being switched from the plug OFF state and the switch OFF state to the switch ON state. However, the trigger for the controller 130 to execute the process in FIG. 7A may be the power switching section 120 changing from the plug ON state and the switch OFF state to the switch ON state. In other words, the controller 130 may execute the process in FIG. 7A when the power button 17B is pressed while the power switching section 120 is in the switch ON state and is subsequently pressed again.

That is, the switch ON state is an example of a first state, and the plug OFF state and switch OFF state are examples of a second state. However, the first state and the second state are not limited to these examples. That is, the first state is a state in which electric power is supplied to at least the recording section 24 and the display section 15, but there is no limitation on supplying electric power to other components. On the other hand, the second state is a state in which electric power is not supplied to at least the recording section 24 and the display section 15, but there is no limitation on supplying electric power to other components.

Further, if electric power is supplied to the residual ink sensor 73 during the switch OFF state, as described below, the controller 130 may store a switch flag in the EEPROM 134 indicating whether the residual ink signal outputted from the residual ink sensor 73 is switched from the second residual ink signal to the first residual ink signal while the power switching section 120 was in the switch OFF state. In this case, the controller 130 may determine the setting of the switch flag in place of the process in S53 and S54. Here, the switch flag indicates whether the residual ink signal is switched from the second residual ink signal to the first residual ink signal during the switch OFF state, remained at the first residual ink signal during the switch OFF state, or remained at the second residual ink signal during the switch OFF state, for example.

When the switch flag indicates that the residual ink signal changed from the second residual ink signal to the first residual ink signal, the controller 130 may skip the process in S55 and S56 for the ink chamber 111B and may execute the process in S57 for the ink chamber 111B. When the switch flag indicates that the residual ink signal remained at the first residual ink signal, the controller 130 may execute the process in S55-S57 for the ink chamber 111B. When the switch flag indicates that the residual ink signal remained at the second residual ink signal, the controller 130 may skip the process in S55-S57 for the ink chamber 111B.

Further, the above-described embodiment describes an example in which electric power is not supplied to the cover sensor 72 and the residual ink sensor 73 during the switch OFF state. However, the power switching section 120 may supply electric power to the controller 130 and the cover sensor 72 in the switch OFF state. In other words, the controller 130 may be capable of detecting the cover open event and the cover close event through the cover sensor 72 while the power switching section 120 is in the switch OFF state.

In the above variation, the EEPROM 134 may also store a refill inference flag. The refill inference flag indicates the results of inferring whether the ink chamber 111 has been refilled with ink. The refill inference flag is either set to "ON" (a first value) that corresponds to inference that the ink chamber 111 has been refilled, or "OFF" (a second value) that corresponds to inference that the ink chamber 111 has not been refilled. The initial value of the refill inference flag is "OFF". The controller 130 may execute a switch OFF process in FIG. 9 in response to the switch of the power switching section 120 from the switch ON state to the switch OFF state.

Figure 9:
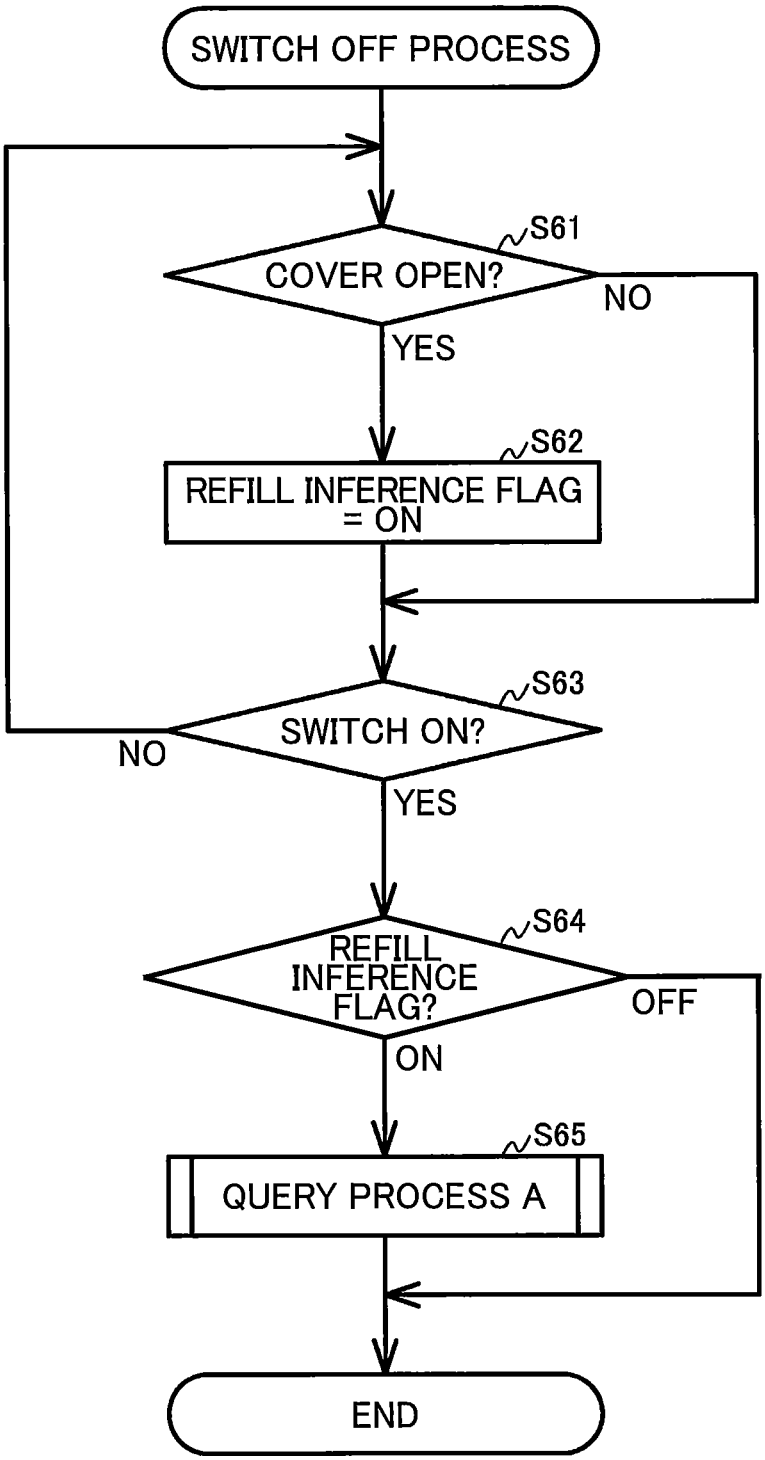
FIG. 9 is a flowchart illustrating steps in a switch OFF process executed by the controller 130.
Figure 10:
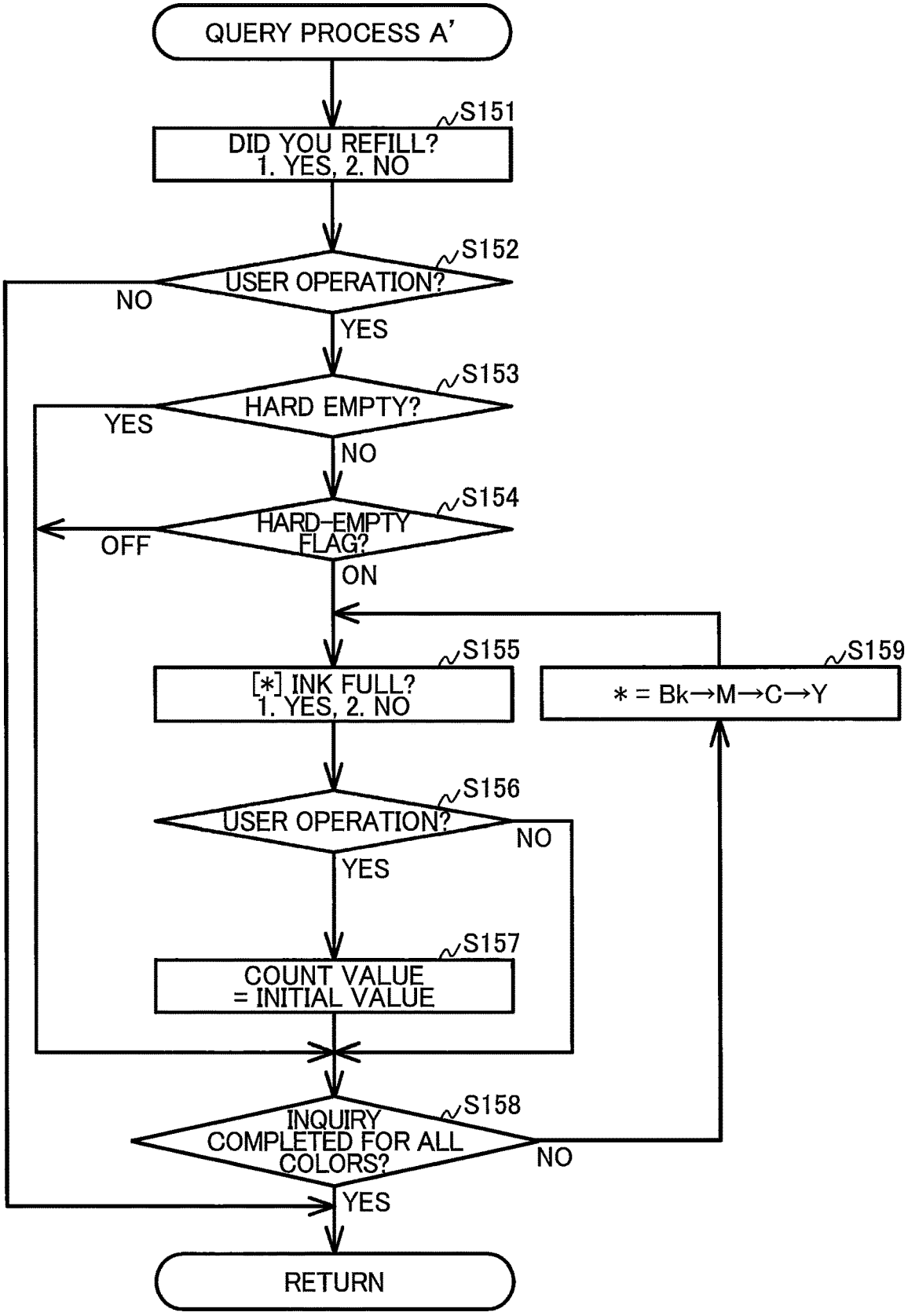
FIG. 10 is a flowchart illustrating steps in a query process A' executed by the controller 130 according to a variation.

In S61 at the beginning of the switch OFF process in FIG. 9, the controller 130 determines whether the cover open event was detected through the cover sensor 72. If the cover open event was not detected (S61: NO), in S63 the controller 130 determines whether the power switching section 120 changed from the switch OFF state to the switch ON state. If the power switching section 120 has not changed to the switch ON state (S63: NO), the controller 130 returns to S61 and continues waiting until either the cover open event has occurred or the power switching section 120 has switched to the switch ON state. In response to the detection of the cover open event while the power switching section 120 remains in the switch OFF state (S61: YES), in S62 the controller 130 sets the refill inference flag to "ON". The process in S62 is an example of a first setting process. Further, in response to the determination that the power switching section 120 has changed from the switch OFF state to the switch ON state (S63: YES), in S64 the controller 130 determines the setting of the refill inference flag. That is, the controller 130 determines whether the cover 70 was moved to the exposing position while the power switching section 120 is in the switch OFF state. The process in S64 is an example of a sixth determination process.

In response to the determination that the refill inference flag is set to "ON" (S64: ON), then in S65 the controller 130 executes the query process A. On the other hand, in response to the determination that the refill inference flag is set to "OFF" (S64: OFF), the controller 130 ends the switch OFF process without executing the process in S65. In this variation, the controller 130 sets the refill inference flag to "OFF" in S57 of the query process A. This process is an example of a second setting process.

With the MFP 10 having such the structure, the user cannot refill the ink chamber 111 with ink without moving the cover 70 to the exposing position. Hence, when the refill inference flag is set to "OFF", it may be assumed that ink has not been supplied while the power switching section 120 was in the switch OFF state. Therefore, the controller 130 can determine whether to execute the query process A based on the setting of the refill inference flag, whereby the MFP 10 in this variation can ensure the accuracy of the count value while simplifying user operations.

Further, the above-described embodiment describes an example of the power switching section 120 supplying electric power acquired from an external power source to components of the MFP 10. However, the power switching section 120 may be configured to supply electric power in the first state from the charged internal power supply 121, rather than electric power acquired from the external power source, to power the components of the MFP 10. In this case, the internal power supply 121 is preferably configured of a large-capacity battery rather than a small-capacity battery that only has the capacity for storing power needed to update the internal clock 135 or to power the cover sensor 72.

The above-mentioned embodiment describes an example in which the ink detection portion 152 and the residual ink sensor 73 are only provided for the tank 100B. However, the ink detection portion 152 and the residual ink sensor 73 may be provided for each of the tanks 100B, 100Y, 100C, and 100M or for none of the tanks 100B, 100Y, 100C, and 100M. For example, when the ink detection portion 152 and the residual ink sensor 73 are provided for each of the tanks 100B, 100Y, 100C, and 100M, in S11, and S18 the controller 130 may employ hard-empty flags Y, C, and M in place of the soft-empty flags Y, C, and M. However, when the ink detection portion 152 and the residual ink sensor 73 are not provided for any of the tanks 100B, 100Y, 100C, and 100M, in S11, and S18 the controller 130 may employ a soft-empty flag B in place of the hard-empty flag.

As another variation, rather than determining the settings of the flags in S11 and S18, the controller 130 may determine whether the ink chambers 111 are in the hard-empty state, the soft-empty state, or the ink low state. Specifically, in S11, and S18 the controller 130 may determine whether the difference between the count value and either the first threshold value or the second threshold value is greater than or equal to 0 for each of the ink chambers 111B, 111Y, 111C, and 111M. The controller 130 may determine in S11 whether the residual ink signal outputted from the residual ink sensor 73 is the first residual ink signal (S11: OFF) or the second residual ink signal (S11: ON).

While the description has been made in detail with reference to the embodiment(s) thereof, it would be apparent to those skilled in the art that many modifications and variations may be made therein without departing from the scope of the disclosure.

What is claimed is:

1. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value and being updated toward the first threshold value in accordance with ejection of ink from the ink chamber;

a display;

an operation interface configured to receive a user operation including a specific operation, a first operation, and a second operation;

a power switching section configured to be switched between a first state and a second state, wherein under the first state, the power switching section supplies an electric power to both the recording head and the display, whereas under the second state, the power switching section interrupts supplying the electric power to both the recording head and the display;

an internal power supply capable of storing an electric power supplied from an external power source; and a controller including an internal clock configured to output time information, the internal clock being operated by the electric power supplied from the external power source when the power switching section is in the first state, the internal clock being operated by an electric power supplied from the internal power supply when the power switching section is in the second state, the time information being set to an initial value in a state where the power switching section is in the second state and when the electric power stored in the internal power supply has been depleted, and wherein the controller is configured to:

receive the specific operation through the operation interface;

in response to receiving the specific operation through the operation interface, switch the power switching section from the second state to the first state;

after the power switching section is switched from the second state to the first state, execute a query process to:

control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value;

in response to the power switching section being switched from the second state to the first state, execute a first determination process to determine whether the time information is set to the initial value; and after determining in the first determination process that the time information is set to the initial value, execute the query process.

2. The inkjet recording apparatus according to claim 1, further comprising a residual ink sensor configured to detect whether a level of the ink stored in the ink chamber is higher than or equal to a detection position, wherein the controller is further configured to:

after the power switching section is switched from the second state to the first state, execute a fifth determination process to determine whether the level of the ink has changed from a position lower than the detection position to a position higher than or equal to the detection position based on a result of detection through the residual ink sensor; and in response to determining in the fifth determination process that the level of ink has changed from the position lower than the detection position to the position higher than or equal to the detection position, execute the query process.

3. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value and being updated toward the first threshold value in accordance with ejection of ink from the ink chamber;

a display;

an operation interface configured to receive a user operation including a specific operation, a first operation, and a second operation;

a power switching section configured to be switched between a first state and a second state, wherein under the first state, the power switching section supplies an electric power to both the recording head and the display, whereas under the second state, the power switching section interrupts supplying the electric power to both the recording head and the display; and a controller including an internal clock configured to output time information, the controller configured to:

receive the specific operation through the operation interface;

in response to receiving the specific operation through the operation interface, switch the power switching section from the second state to the first state;

after the power switching section is switched from the second state to the first state, execute a query process to:

control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value;

after the power switching section is switched from the second state to the first state, execute a second determination process to determine whether a non-powered time duration is longer than or equal to a time threshold, the non-powered time duration being a time interval during which the power switching section is in the second state and being indicated using the time information outputted from the internal clock;

after determining in the second determination process that the non-powered time duration is longer than or equal to the time threshold, execute the query process; and in response to determining in the second determination process that the non-powered time duration is shorter than the time threshold, not execute the query process.

4. The inkjet recording apparatus according to claim 3, further comprising a residual ink sensor configured to detect whether a level of the ink stored in the ink chamber is higher than or equal to a detection position, wherein the controller is further configured to:

after the power switching section is switched from the second state to the first state, execute a fifth determination process to determine whether the level of the ink has changed from a position lower than the detection position to a position higher than or equal to the detection position based on a result of detection through the residual ink sensor; and in response to determining in the fifth determination process that the level of ink has changed from the position lower than the detection position to the position higher than or equal to the detection position, execute the query process.

5. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value and being updated toward the first threshold value in accordance with ejection of ink from the ink chamber;

a display;

an operation interface configured to receive a user operation including a specific operation, a first operation, and a second operation;

a power switching section configured to be switched between a first state and a second state, wherein under the first state, the power switching section supplies an electric power to both the recording head and the display, whereas under the second state, the power switching section interrupts supplying the electric power to both the recording head and the display; and a controller configured to:

receive the specific operation through the operation interface;

in response to receiving the specific operation through the operation interface, switch the power switching section from the second state to the first state;

after the power switching section is switched from the second state to the first state, execute a query process to:

control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value;

wherein the memory further stores a second threshold value, a difference between the second threshold value and the count value reaching zero (0) before the difference between the first threshold value and the count value reaches zero (0), and wherein the controller is further configured to:

after the power switching section is switched from the second state to the first state, execute a third determination process to determine whether a difference between the accumulated count value and the initial value is greater than a difference between the second threshold value and the initial value;

after determining in the third determination process that the difference between the accumulated count value and the initial value is greater than the difference between the second threshold value and the initial value, execute the query process; and in response to determining in the third determination process that the difference between the accumulated count value and the initial value is equal to or smaller than the difference between the second threshold value and the initial value, not execute the query process.

6. The inkjet recording apparatus according to claim 5, wherein the controller is further configured to:

execute a recording process to record an image on a sheet;

execute an updating process to update the count value in accordance with an amount of ejection of ink from the recording head;

after executing the updating process, execute a fourth determination process to determine whether the difference between the accumulated count value and the initial value is greater than the difference between the second threshold value and the initial value; and in response to determining in the fourth determination process that the difference between the accumulated count value and the initial value is greater than the difference between the second threshold value and the initial value, execute a notification process to control the display to continuously display a notification screen until the initialization process is executed, the notification screen indicating that the ink chamber needs to be refilled with ink.

7. The inkjet recording apparatus according to claim 5, wherein the controller is further configured to:

execute a recording process to record an image on a sheet;

execute an updating process to update the count value in accordance with an amount of ejection of ink from the recording head;

after executing the updating process, execute a fourth determination process to determine whether the difference between the accumulated count value and the initial value is greater than the difference between the second threshold value and the initial value; and in response to determining in the fourth determination process that the difference between the accumulated count value and the initial value is greater than the difference between the second threshold value and the initial value, execute a notification process to control the display to continuously display a notification screen until the power switching section is switched to the second state, the notification screen indicating that the ink chamber needs to be refilled with ink.

8. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value and being updated toward the first threshold value in accordance with ejection of ink from the ink chamber;

a display;

an operation interface configured to receive a user operation including a specific operation, a first operation, and a second operation;

a power switching section configured to be switched between a first state and a second state, wherein under the first state, the power switching section supplies an electric power to both the recording head and the display, whereas under the second state, the power switching section interrupts supplying the electric power to both the recording head and the display;

a residual ink sensor configured to detect whether a level of the ink stored in the ink chamber is higher than or equal to a detection position; and a controller configured to:

receive the specific operation through the operation interface;

in response to receiving the specific operation through the operation interface, switch the power switching section from the second state to the first state;

after the power switching section is switched from the second state to the first state, execute a query process to:

control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value;

after the power switching section is switched from the second state to the first state, execute a fifth determination process to determine whether the level of the ink has changed from a position lower than the detection position to a position higher than or equal to the detection position based on a result of detection through the residual ink sensor; and in response to determining in the fifth determination process that the level of ink has changed from the position lower than the detection position to the position higher than or equal to the detection position, execute the initialization process without executing the query process.

9. The inkjet recording apparatus according to claim 8, wherein the ink chamber includes a first ink chamber and a second ink chamber, wherein the count value includes a first count value indicative of the count value for the first ink chamber and a second count value indicative of the count value for the second ink chamber, wherein the residual ink sensor is configured to detect whether a level of ink stored in the first ink chamber is higher than or equal to a detection position, wherein the controller is further configured to:

execute the fifth determination process to determine whether the level of the ink stored in the first ink chamber has changed from a position lower than the detection position to a position higher than or equal to the detection position based on a result of detection through the residual ink sensor;

after determining in the fifth determination process that the level of ink stored in the first ink chamber has changed from the position lower than the detection position to the position higher than or equal to the detection position, execute the initialization process to set the first count value to a first initial value without executing the query process targeting the first ink chamber;

execute the query process targeting the second ink chamber; and in response to receiving the first operation in the query process targeting the second ink chamber, execute the initialization process to set the second count value to a second initial value.

10. The inkjet recording apparatus according to claim 9, wherein, in response to determining in the fifth determination process that the level of ink stored in the first ink chamber has remained at the position lower than the detection position, the controller is further configured to:

non-execute the query process targeting the first ink chamber and the initialization process targeting the first ink chamber;

execute the query process targeting the second ink chamber; and in response to receiving the first operation in the query process targeting the second ink chamber, execute the initialization process to set the second count value to the second initial value.

11. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value and being updated toward the first threshold value in accordance with ejection of ink from the ink chamber;

a display;

an operation interface configured to receive a user operation including a specific operation, a first operation, and a second operation;

a power switching section configured to be switched between a first state and a second state, wherein under the first state, the power switching section supplies an electric power to both the recording head and the display, whereas under the second state, the power switching section interrupts supplying the electric power to both the recording head and the display;

a cover movable between a covering position covering the inlet to restrict injection of ink into the ink chamber and an exposing position exposing the inlet to an outside to allow injection of ink into the ink chamber;

a cover sensor configured to detect whether the cover is in the covering position or the exposing position; and a controller configured to:

receive the specific operation through the operation interface;

in response to receiving the specific operation through the operation interface, switch the power switching section from the second state to the first state;

after the power switching section is switched from the second state to the first state, execute a query process to:

control the display to display a query screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; and in response to receiving the first operation in the query process, execute an initialization process to set the count value to the initial value;

wherein the second state includes a plug OFF state and a switch OFF state, the power switching section in the plug OFF state interrupting supply of an electric power from an external power source, the power switching section in the switch OFF state being configured to supply an electric power to the controller and the cover sensor, wherein the memory further stores a refill inference flag, and wherein the controller is further configured to:

while the power switching section is in the switch OFF state, in response to detecting through the cover sensor that the cover was moved to the exposing position, execute a first setting process to set the refill inference flag to a first value;

in response to receiving the first operation in the query process, execute a second setting process to set the refill inference flag to a second value;

in response to the power switching section being switched from the switch OFF state to the first state, execute a sixth determination process to determine whether the refill inference flag is set to either one of the first value and the second value;

after determining in the sixth determination process that the refill inference flag is set to the first value, execute the query process; and in response to determining in the sixth determination process that the refill inference flag is set to the second value, not execute the query process.

12. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value;

a display;

an operation interface configured to output a first operation signal, a second operation signal, and a third operation signal;

a power switching section configured to be switched between a first state and a second state, wherein under the first state, the power switching section supplies an electric power to both the recording head and the display, whereas under the second state, the power switching section interrupts supplying the electric power to both the recording head and the display;

an internal power supply capable of storing an electric power supplied from an external power source; and a controller configured to update the count value toward the first threshold value in accordance with ejection of ink from the ink chamber, the controller being further configured to:

receive the third operation signal from the operation interface;

in response to receiving the third operation signal, switch the power switching section from the second state to the first state;

after the power switching section is switched from the second state to the first state, execute a query process to:

control the display to display a query screen inquiring whether the ink chamber has been refilled with ink; and receive either one of the first operation signal and the second operation signal from the operation interface, wherein the first operation signal indicates that the ink chamber has been refilled with ink, whereas the second operation signal indicates that the ink chamber has not been refilled with ink; and in response to receiving the first operation signal in the query process, execute an initialization process to set the count value to the initial value;

wherein the controller includes an internal clock configured to output time information, the internal clock being operated by the electric power supplied from the external power source when the power switching section is in the first state, the internal clock being operated by an electric power supplied from the internal power supply when the power switching section is in the second state, the time information being set to an initial value in a state where the power switching section is in the second state and when the electric power stored in the internal power supply has been depleted, and wherein the controller is further configured to:

in response to the power switching section being switched from the second state to the first state, execute a first determination process to determine whether the time information is set to the initial value; and after determining in the first determination process that the time information is set to the initial value, execute the query process.

13. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value;

a display;

an operation interface configured to output a first operation signal, a second operation signal, and a third operation signal;

a power switching section configured to be switched between a first state and a second state, wherein under the first state, the power switching section supplies an electric power to both the recording head and the display, whereas under the second state, the power switching section interrupts supplying the electric power to both the recording head and the display; and a controller including an internal clock configured to output time information and configured to update the count value toward the first threshold value in accordance with ejection of ink from the ink chamber, the controller being further configured to:

receive the third operation signal from the operation interface;

in response to receiving the third operation signal, switch the power switching section from the second state to the first state;

after the power switching section is switched from the second state to the first state, execute a query process to:

control the display to display a query screen inquiring whether the ink chamber has been refilled with ink; and receive either one of the first operation signal and the second operation signal from the operation interface, wherein the first operation signal indicates that the ink chamber has been refilled with ink, whereas the second operation signal indicates that the ink chamber has not been refilled with ink;

in response to receiving the first operation signal in the query process, execute an initialization process to set the count value to the initial value;

after the power switching section is switched from the second state to the first state, execute a second determination process to determine whether a non-powered time duration is longer than or equal to a time threshold, the non-powered time duration being a time interval during which the power switching section is in the second state and being indicated using the time information outputted from the internal clock;

after determining in the second determination process that the non-powered time duration is longer than or equal to the time threshold, execute the query process; and in response to determining in the second determination process that the non-powered time duration is shorter than the time threshold, not execute the query process.

14. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value accumulated from an initial value;

a display;

an operation interface configured to output a first operation signal, a second operation signal, and a third operation signal;

a power switching section configured to be switched between a first state and a second state, wherein under the first state, the power switching section supplies an electric power to both the recording head and the display, whereas under the second state, the power switching section interrupts supplying the electric power to both the recording head and the display; and a controller configured to update the count value toward the first threshold value in accordance with ejection of ink from the ink chamber, the controller being further configured to:

receive the third operation signal from the operation interface;

in response to receiving the third operation signal, switch the power switching section from the second state to the first state;

after the power switching section is switched from the second state to the first state, execute a query process to:

control the display to display a query screen inquiring whether the ink chamber has been refilled with ink; and receive either one of the first operation signal and the second operation signal from the operation interface, wherein the first operation signal indicates that the ink chamber has been refilled with ink, whereas the second operation signal indicates that the ink chamber has not been refilled with ink; and in response to receiving the first operation signal in the query process, execute an initialization process to set the count value to the initial value;

wherein the memory further stores a second threshold value, a difference between the second threshold value and the count value reaching zero (0) before the difference between the first threshold value and the count value reaches zero (0), and wherein the controller is further configured to:

after the power switching section is switched from the second state to the first state, execute a third determination process to determine whether a difference between the accumulated count value and the initial value is greater than a difference between the second threshold value and the initial value;

after determining in the third determination process that the difference between the accumulated count value and the initial value is greater than the difference between the second threshold value and the initial value, execute the query process; and in response to determining in the third determination process that the difference between the accumulated count value and the initial value is equal to or smaller than the difference between the second threshold value and the initial value, not execute the query process.

* * * * *